US010336942B2

(12) United States Patent
Bowser, Jr.

(10) Patent No.: US 10,336,942 B2
(45) Date of Patent: Jul. 2, 2019

(54) COKE OVEN CORBEL STRUCTURES AND METHODS OF FORMING THE SAME

(71) Applicant: FOSBEL, INC., Brook Park, OH (US)

(72) Inventor: Alan E. Bowser, Jr., Brook Park, OH (US)

(73) Assignee: FOSBEL, INC., Brook Park, OH (US)

( * ) Notice: Subject to any disclaimer, the term of this patent is extended or adjusted under 35 U.S.C. 154(b) by 724 days.

(21) Appl. No.: 14/947,320

(22) Filed: Nov. 20, 2015

(65) Prior Publication Data

US 2016/0145494 A1 May 26, 2016

Related U.S. Application Data

(60) Provisional application No. 62/082,922, filed on Nov. 21, 2014.

(51) Int. Cl.

| | |
|---|---|
| ***C10B 5/00*** | (2006.01) |
| ***C10B 5/02*** | (2006.01) |
| ***C10B 29/00*** | (2006.01) |
| ***C10B 29/02*** | (2006.01) |
| ***F27D 1/04*** | (2006.01) |

(Continued)

(52) U.S. Cl.

CPC ..... *C10B 29/02* (2013.01); *F27B 13/02* (2013.01); *F27B 13/06* (2013.01); *F27B 13/08* (2013.01); *F27B 13/10* (2013.01); *F27D 1/04* (2013.01); *F27D 1/063* (2013.01); *C10B 5/00* (2013.01); *C10B 5/02* (2013.01); *C10B 29/00* (2013.01)

(58) Field of Classification Search

CPC ..... C10B 29/02; C10B 29/06; C10B 5/00–20; C10B 3/00; C10B 3/02; C10B 15/00; C10B 15/02; F27D 1/04; F27D 1/042; F27D 1/06; F27D 1/063; F27D 1/066

USPC ..... 202/222, 223

See application file for complete search history.

(56) References Cited

U.S. PATENT DOCUMENTS 1,399,275 A * 12/1921 Roberts ..... C10B 29/02 165/168

1,404,061 A * 1/1922 Roberts ..... C10B 29/02 165/168

(Continued)

FOREIGN PATENT DOCUMENTS

DE 1 127 325 4/1962

OTHER PUBLICATIONS

International Search Report and Written Opinion, PCT/US2015/061844, dated Feb. 23, 2016.

*Primary Examiner* — Jonathan Miller
*Assistant Examiner* — Jonathan Luke Pilcher
(74) *Attorney, Agent, or Firm* — Nixon & Vanderhye P.C.

(57) ABSTRACT

Coke oven corbel structures include an assembly of multiple stacked tiers of refractory blocks defining a plurality of substantially vertically oriented central flues and a plurality of diagonally oriented lateral flues. At least one tier of refractory blocks in the assembly includes a plurality of tongue-and-groove interconnected refractory blocks. This plurality of interconnected refractory blocks of the at least one tier comprise mutually substantially orthogonal faces defining an edge and respectively including an elongate tongue protruding outwardly therefrom and an elongate groove recessed therein. The elongate tongue and groove include respective adjacent ends which co-terminate with one another at the edge defined by the mutually orthogonal faces of the refractory blocks.

21 Claims, 26 Drawing Sheets

(51) Int. Cl.

| | |
|---|---|
| ***F27B 13/02*** | (2006.01) |
| ***F27B 13/06*** | (2006.01) |
| ***F27B 13/08*** | (2006.01) |
| ***F27B 13/10*** | (2006.01) |
| ***F27D 1/06*** | (2006.01) |

(56) References Cited

U.S. PATENT DOCUMENTS

| | | | | | |
|---|---|---|---|---|---|
| 1,430,027 | A * | 9/1922 | Plantinga | C10B 29/02 | 202/223 |
| 2,141,035 | A * | 12/1938 | Daniels | C10B 29/02 | 202/223 |
| 6,066,236 | A | 5/2000 | Gilroy | | |
| 8,640,635 | B2 * | 2/2014 | Bloom | C10B 5/12 | 110/338 |
| 2010/0287871 | A1 * | 11/2010 | Bloom | C10B 5/12 | 52/505 |
| 2013/0015050 | A1 * | 1/2013 | Bloom | C10B 5/12 | 202/99 |

* cited by examiner

COKE OVEN CORBEL STRUCTURES AND METHODS OF FORMING THE SAME

CROSS-REFERENCE TO RELATED APPLICATION

This application is related to and claims domestic priority benefits under 35 USC § 119(e) from U.S. Provisional Application Ser. No. 62/082,922 filed on Nov. 21, 2014, the entire contents of which are expressly incorporated hereinto by reference.

FIELD

The embodiments disclosed herein relate generally to coke ovens, especially corbel structures associated with coke ovens. In preferred embodiments, the corbel structures disclosed herein are formed of an assembly of monolithic refractory blocks.

BACKGROUND

Coke ovens traditionally comprise massive refractory brick structures in which there are batteries of adjacent parallel walls made up from a large variety of differently shaped refractory bricks. The bricks must be able to withstand high temperatures and strong mechanical loading. At the same time, the interior of the walls contains flue ducts, burners, flue gas control passages and the like. The detailed design of the oven is usually quite complicated in order to obtain the necessary heat distribution within the oven and gas flows through the walls.

It follows from the above that coke ovens are relatively costly structures and any downtime for servicing and repairs can represent a significant economic loss for an operator.

Further, the production of ceramic bricks from which the walls are made is relatively costly and there is accordingly a need to generally reduce the number of different types of bricks which are used in a wall. It is undesirable, however, to have a design concept which utilizes relatively large ceramic bricks in the construction. Excessively large bricks cannot be handled without the use of specialized mechanical lifting devices. Further, bricks having a dimension greater than 650 mm machine pressed to form a fused silica product are generally unavailable. Bricks greater than this size can be hand cast but these are much more expensive. Large bricks can be machine pressed from conventional silica, but conventional silica bricks would have a very serious disadvantage in that a wall made therefrom would need a heat-up time which is many times greater than that for fused silica bricks.

U.S. Pat. Nos. 6,066,236, 8,266,853 and 8,640,635 (the entire content of each such patent being expressly incorporated hereinto by reference) have proposed that relatively large-sized monolithic refractory blocks may be assembled to form the corbel structures of coke ovens. In general, the assembly of such large-sized monolithic refractory blocks enables the coke ovens to be constructed and/or repaired with much less production down time.

While such prior proposals for coke oven corbel structures are satisfactory for their intended purpose, continual improvements are sought. It is towards providing such improvements that the embodiments disclosed herein are directed.

SUMMARY

The coke oven corbel structures of the embodiments disclosed herein include an assembly of multiple stacked tiers of refractory blocks defining a plurality of substantially vertically oriented central flues and a plurality of diagonally oriented lateral flues. At least one tier of refractory blocks in the assembly includes a plurality of tongue-and-groove interconnected refractory blocks. This plurality of interconnected refractory blocks of the at least one tier comprise mutually substantially orthogonal faces defining an edge and respectively including an elongate tongue protruding outwardly therefrom and an elongate groove recessed therein. The elongate tongue and groove include respective adjacent ends which co-terminate with one another at the edge defined by the mutually orthogonal faces of the refractory blocks.

The tongue and groove interconnection provided by the embodiments herein provide for an assembly of refractory blocks. In addition, the tongue and groove interconnection provides for reliable joint seals between adjacently interconnected refractory blocks to substantially minimize (if not prevent entirely) the escape of flue gas from the coke oven.

The multiple stacked tiers of refractory blocks may include a respective end block having a front face, wherein the front face includes a substantially vertically oriented tongue and a substantially vertically oriented groove parallel with the tongue, the tongue and groove of the front face being interconnected with a groove and tongue, respectively, of a substantially vertical face of an adjacent block in the tier.

The top faces of the blocks in the at least one tier may be provided with a parallel set of longitudinally extending grooves to receive therein a corresponding set of longitudinally extending tongues formed in a bottom face of an adjacently stacked tier.

At least one tier may be provided with a plurality of flue blocks each defining at least one portion of respective vertically oriented flues of the corbel structure. Certain embodiments of the flue blocks may also provide for a portion of at least one diagonally oriented flue of the corbel structure located laterally of the central flues.

Some blocks in the at least one tier may include opposed mirror image pair of generally cruciform-shaped blocks. The cruciform-shaped blocks may comprise an elongate central section, an inwardly projecting leg section and an outwardly projecting leg section, each of the inwardly and outwardly projecting leg sections being substantially perpendicular to the elongate central section. The inwardly projecting leg section may include a parallel substantially vertically oriented tongue and groove. According to some embodiments, the lateral side of the cruciform-shaped blocks includes a pair of downwardly and outwardly sloped surfaces on each side of the outwardly projecting leg section.

Certain embodiments of the corbel structure will include a tier of blocks having a plurality of alternating generally I-shaped transverse blocks interconnected with a respective pair of spacer blocks. The I-shaped transverse blocks may include opposed end sections, a central section, between the end sections and a boss protruding outwardly from a substantial mid-region of the central section. The transverse blocks according to some embodiments will include a substantially vertical side opposite to the boss, and wherein the substantially vertical side includes a reentrant section between the opposed end sections which defines a first recess having lateral substantially planar recessed rear faces and a second recess having a substantially planar recessed central face.

Spacer blocks which include downwardly and outwardly sloped lateral side surface may be provided in a tier of the corbel structure.

Lateral flue blocks defining a diagonally oriented flue section of the lateral flues of the corbel structure may also be provided. Such lateral flue block may include a boss extending outwardly from one side of the block and a generally L-shaped step extending outwardly from a side of the block opposite to the boss. According to some embodiments, the boss includes opposed side faces having a tongue and groove respectively formed therein. The lateral flue block may have a top face defining a substantially rectangular opening to the flue portion, the opening being symmetrically positioned with respect to longitudinal and latitudinal axes of the flue block or may have an opening that is asymmetrically off-set with respect to the longitudinal centerline of the block but symmetrically positioned with respect to the latitudinal centerline thereof.

A tier of the corbel structure may be provided with transverse blocks comprised of a plurality of transverse blocks having a base section and a platform section extending upwardly from the base section. The transverse blocks may comprise a substantially vertically oriented central flue portion of the central flue of the corbel structure and opposed diagonally oriented lateral flue portions of the lateral flues of the corbel structure.

The corbel structure may have a tier of blocks which comprise a back-to-back pair of flue blocks integrally including a base section and flue section extending upwardly from one end of the flue section.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

FIGS. 4A-1 through 4A-3 show an end block associated with the first tier of blocks forming the corbel structure, wherein FIG. 4A-1 is a perspective view thereof, FIG. 4A-2 is a top plan view thereof and FIG. 4A-3 is a front elevational view thereof;

FIGS. 4B-1 through 4B-3 show a first flue block associated with the first tier of blocks forming the corbel structure, wherein FIG. 4B-1 is a perspective view thereof, FIG. 4B-2 is a top plan view thereof and FIG. 4B-3 is a cross-sectional elevational view as taken along line 4B-3 in FIG. 4B-2;

FIGS. 4C-1 through 4C-3 show a second flue block associated with the first tier of blocks forming the corbel structure, wherein FIG. 4C-1 is a perspective view thereof, FIG. 4C-2 is a top plan view thereof and FIG. 4C-3 is a cross-sectional elevational view as taken along line 4C-3 in FIG. 4C-2;

FIGS. 4D-1 through 4D-3 show a third flue block associated with the first tier of blocks forming the corbel structure, wherein FIG. 4D-1 is a perspective view thereof, FIG. 4D-2 is a top plan view thereof and FIG. 4D-3 is a cross-sectional elevational view as taken along line 4D-3 in FIG. 4D-2;

FIGS. 5A-1 through 5A-3 show an end block associated with the second tier of blocks forming the corbel structure, wherein FIG. 5A-1 is a perspective view thereof, FIG. 5A-2 is a top plan view thereof and FIG. 5A-3 is a front elevational view thereof;

FIGS. 5B-1 through 5B-3 show a lateral block associated with the second tier of blocks forming the corbel structure, wherein FIG. 5B-1 is a perspective view thereof, FIG. 5B-2 is a top plan view thereof, and FIG. 5B-3 is a front elevational view thereof;

FIGS. 5C-1 through 5C-3 show a spanner block associated with the second tier of blocks forming the corbel structure, wherein FIG. 5C-1 is a perspective view thereof, FIG. 5C-2 is a top plan view thereof, and FIG. 5C-3 is a front elevational view thereof;

FIGS. 5D-1 through 5D-3 show a spacer block associated with the second tier of blocks forming the corbel structure, wherein FIG. 5D-1 is a perspective view thereof, FIG. 5D-2 is a top plan view thereof, and FIG. 5D-3 is a side elevational view thereof;

FIGS. 6A-1 through 6A-3 show an end block associated with the third tier of blocks forming the corbel structure, wherein FIG. 6A-1 is a perspective view thereof, FIG. 6A-2 is a top plan view thereof and FIG. 6A-3 is a front elevational view thereof;

Figure 1:
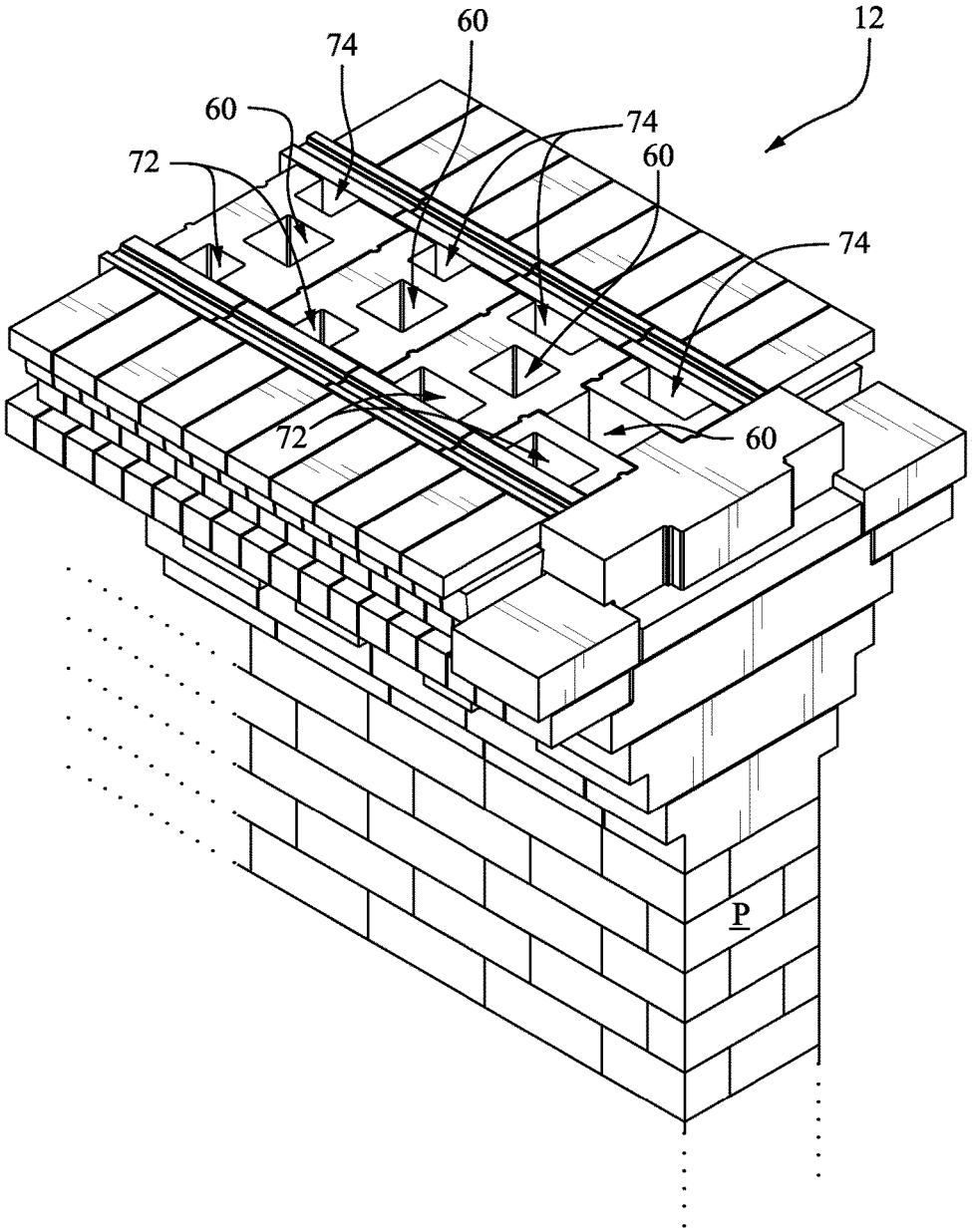
FIG. 1 is a perspective view showing an exemplary corbel structure in accordance with an embodiment of the present invention supported on a coke oven pier.
Figure 3:
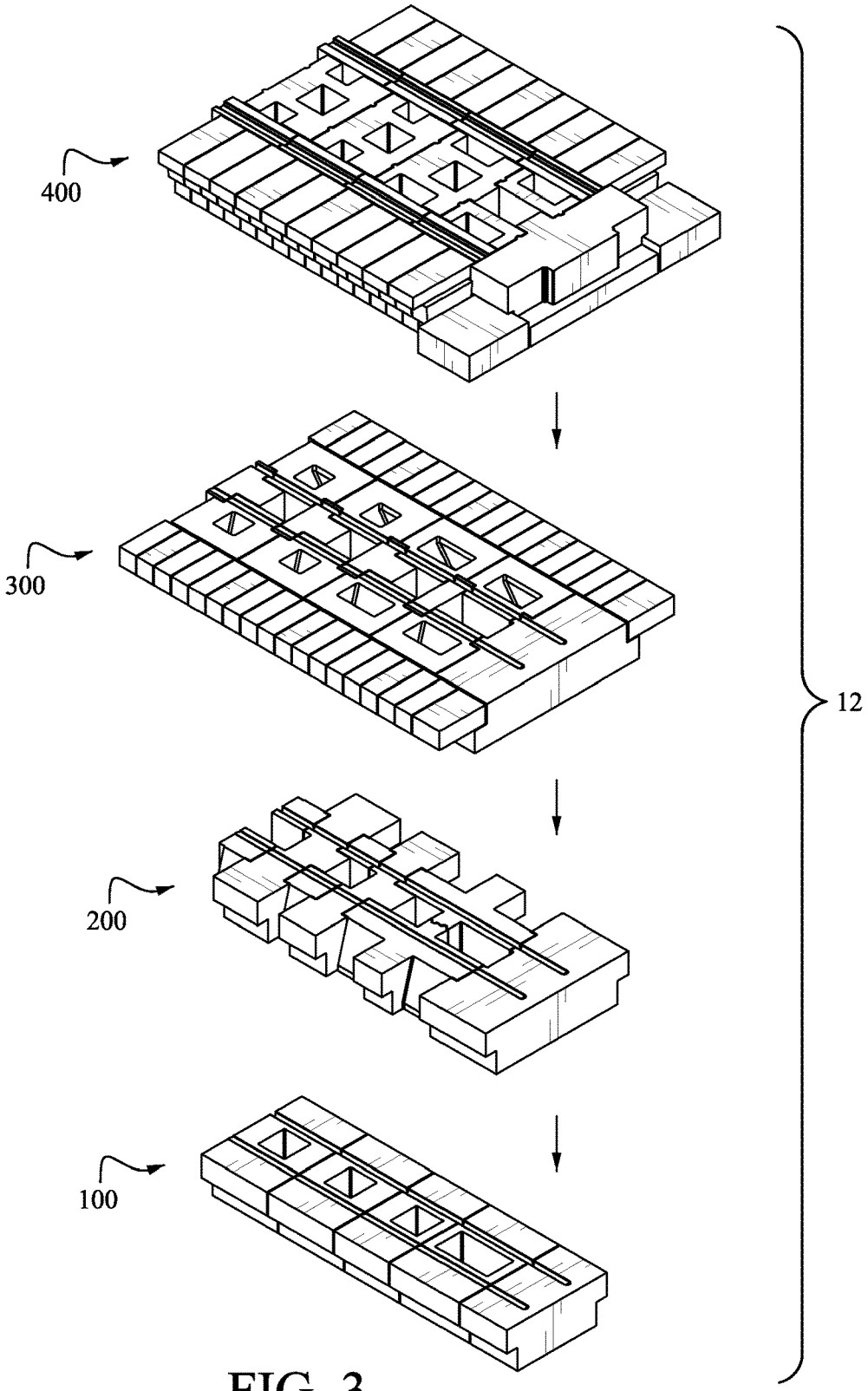
FIG. 3 is an exploded perspective view of the corbel structure depicted in FIG. 1 showing the respective tiers forming the same.
Figure 4:
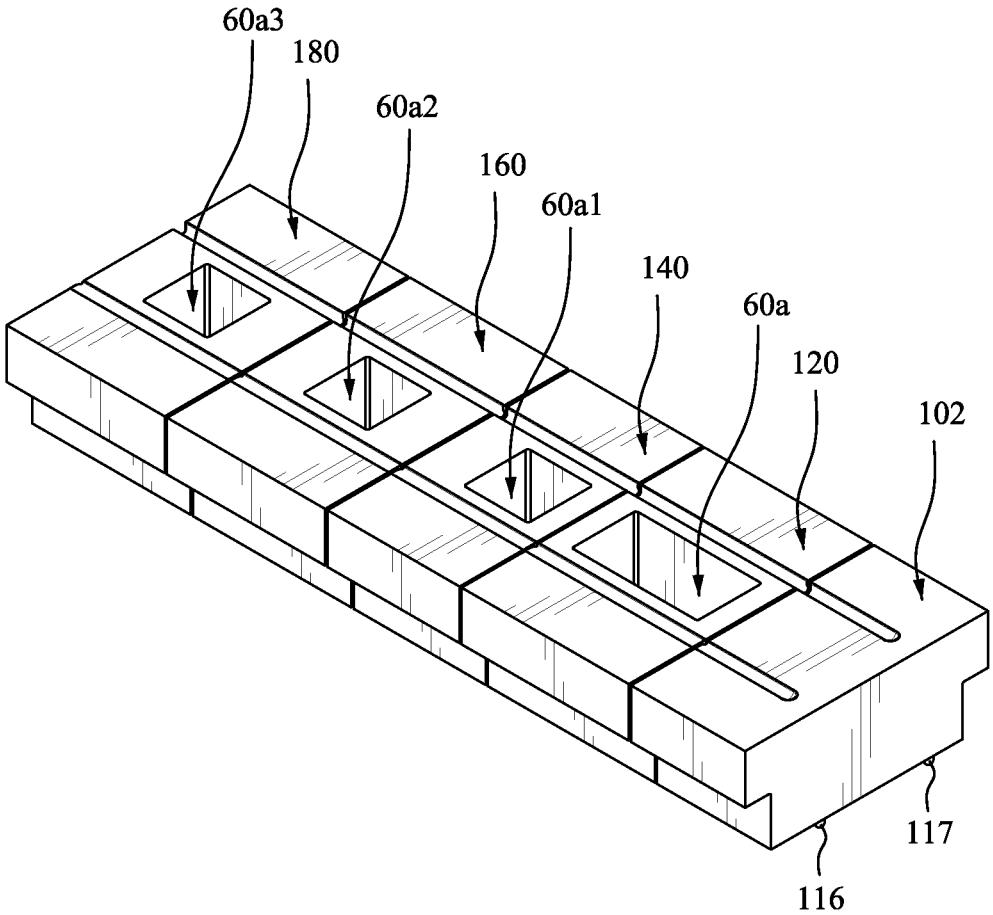
FIG. 4 is an enlarged perspective assembled view of the first tier of blocks forming the corbel structure.
Figures 1, 4A:
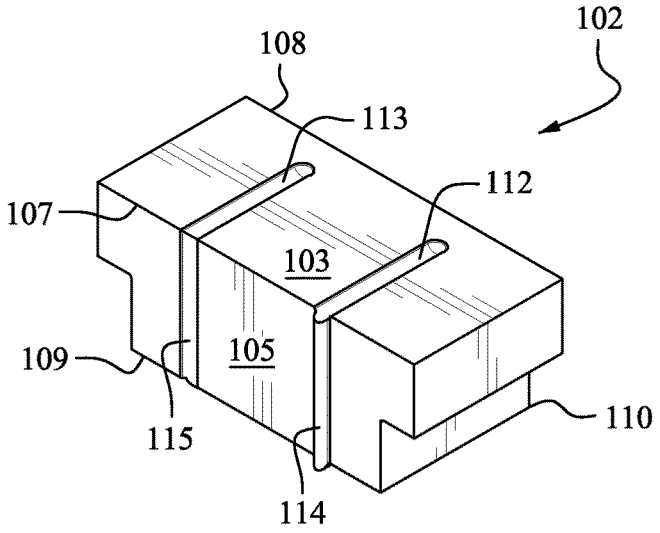
Figures 2, 4A:
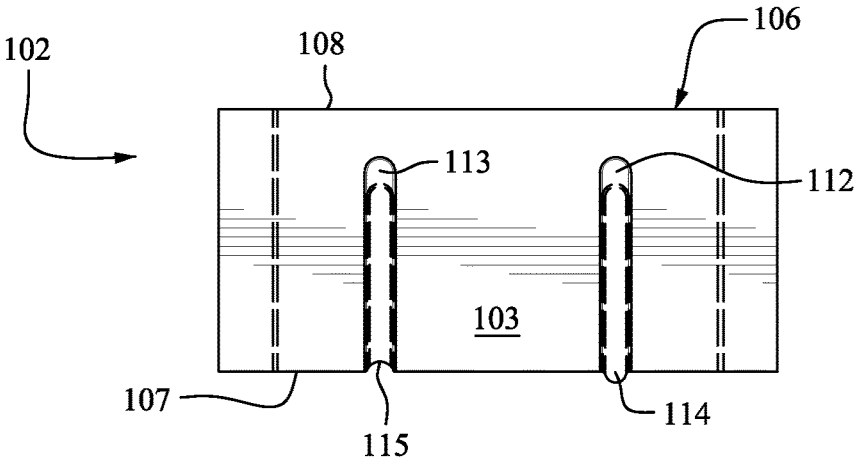
Figures 3, 4A:
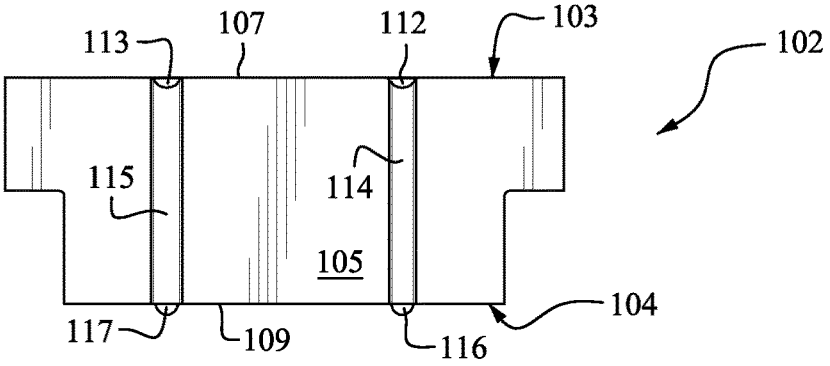
Figure 6:
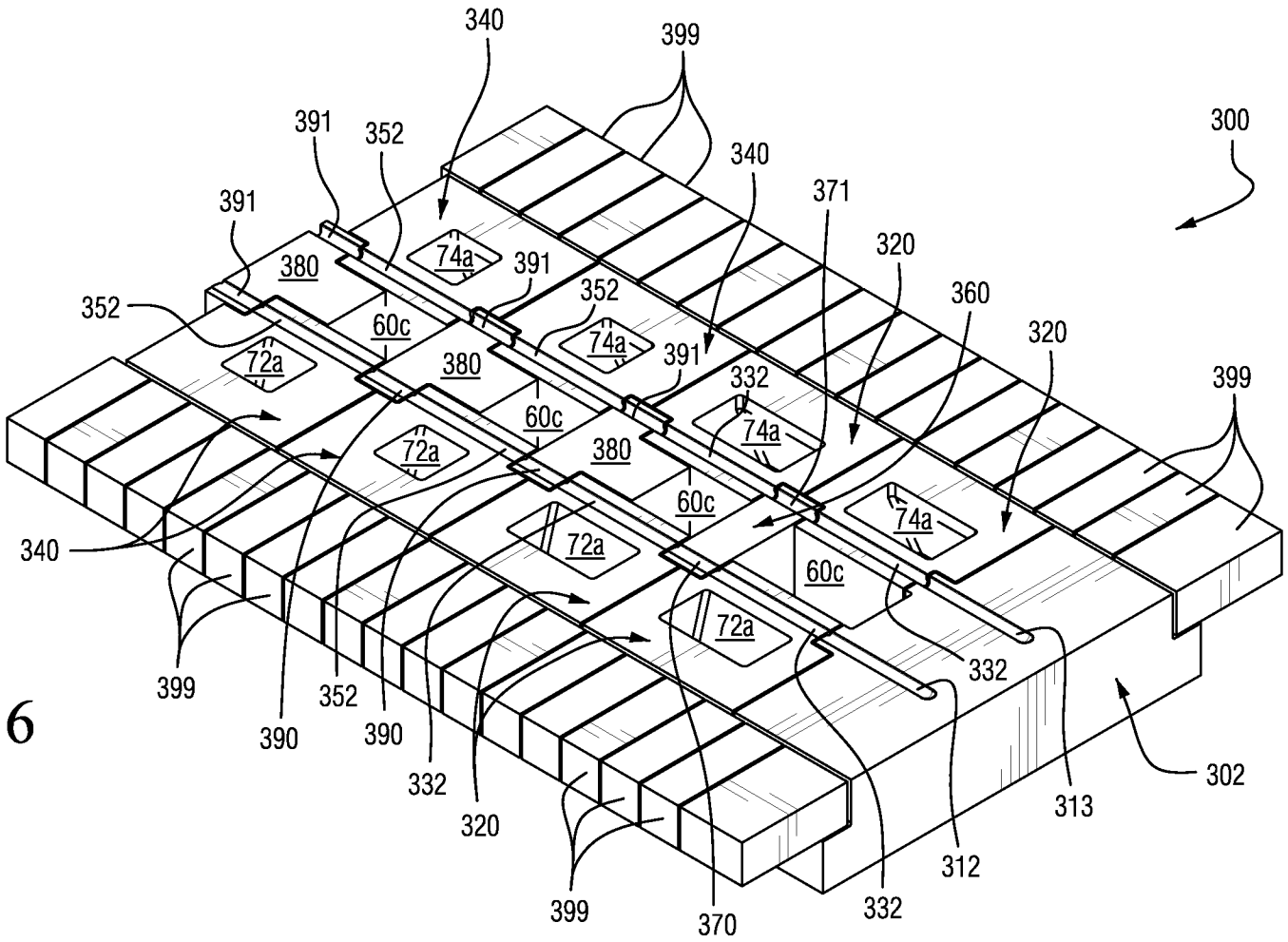
FIG. 6 is an enlarged perspective assembled view of the third tier of blocks forming the corbel structure.
Figures 1, 6A:
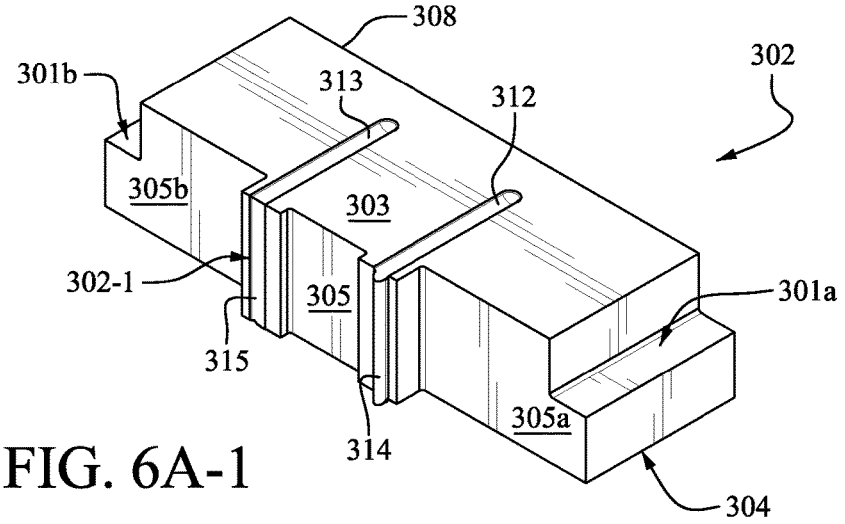
Figures 2, 6A:
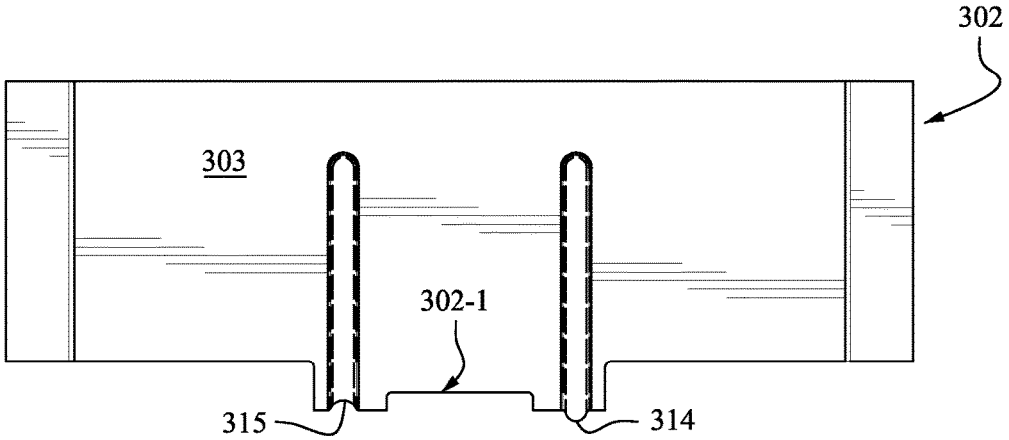
Figures 3, 6A:
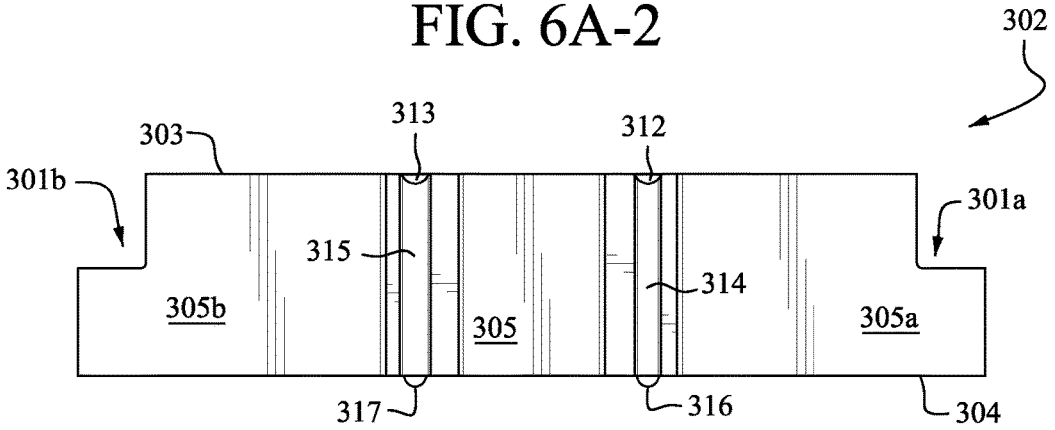
Figures 1, 6B:
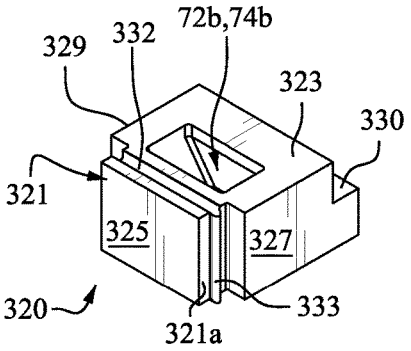
Figures 2, 6B:
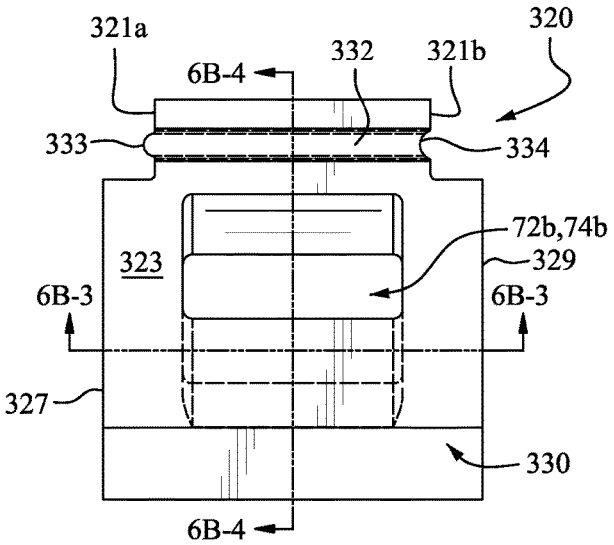
Figures 3, 6B:
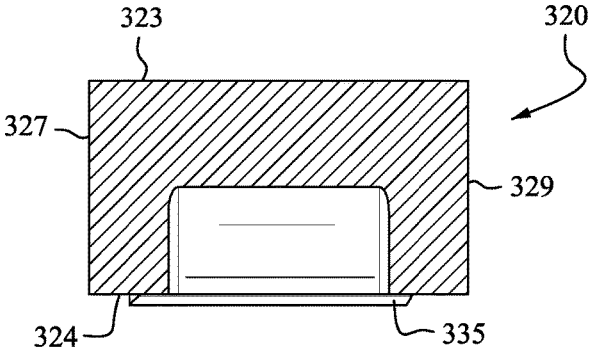
Figures 4, 6B:
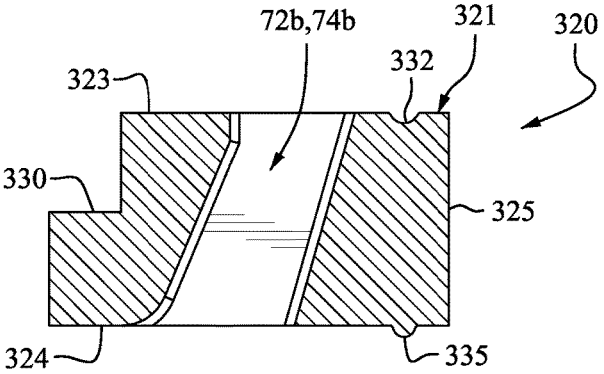
Figures 1, 6C:
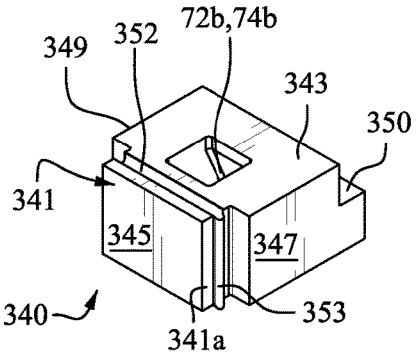
Figures 2, 6C:
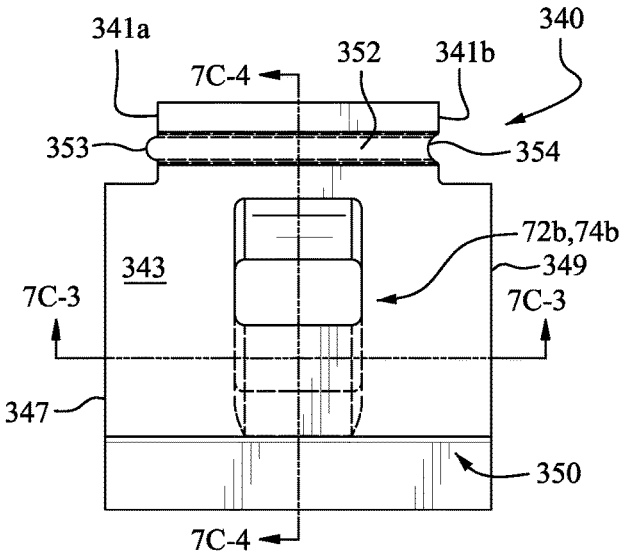
Figures 3, 6C:
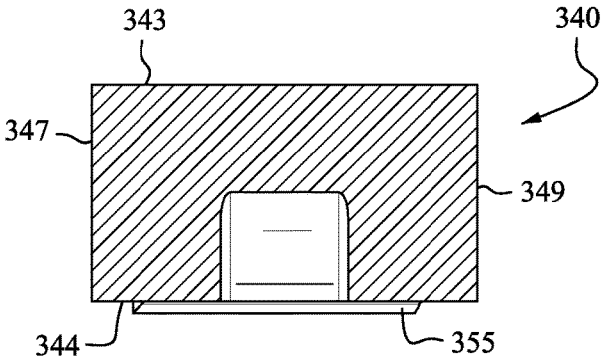
Figures 4, 6C:
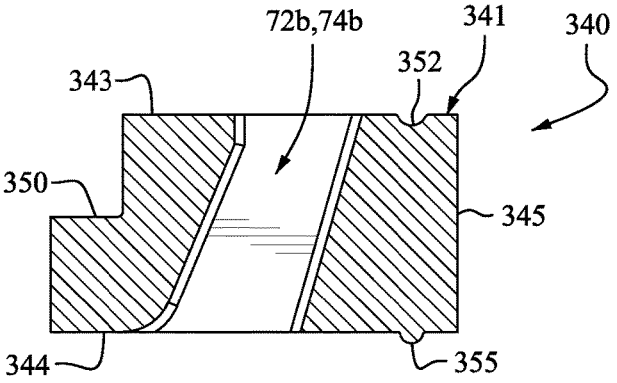
Figures 1, 6D:
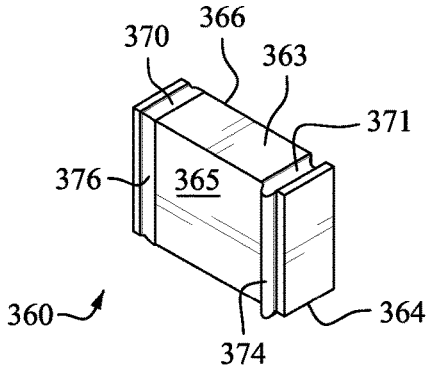
Figures 1, 6E:
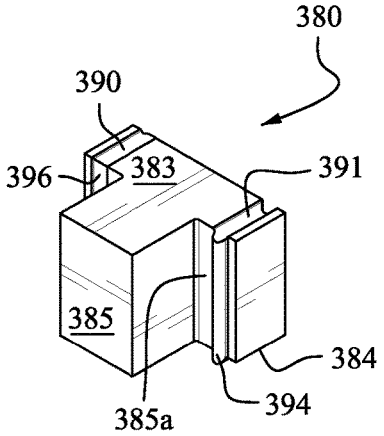
Figures 2, 6D:
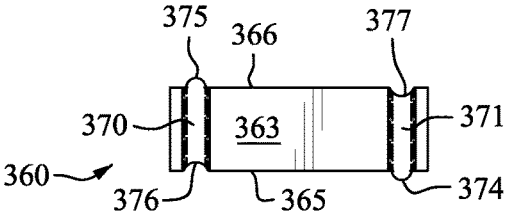
Figures 2, 6E:
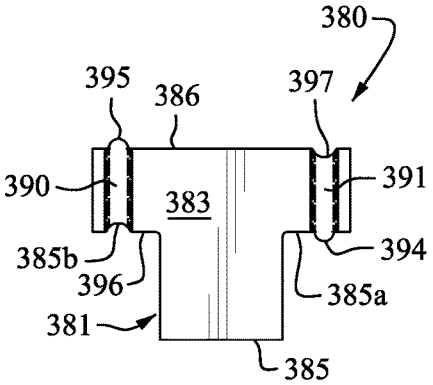
Figures 3, 6D:
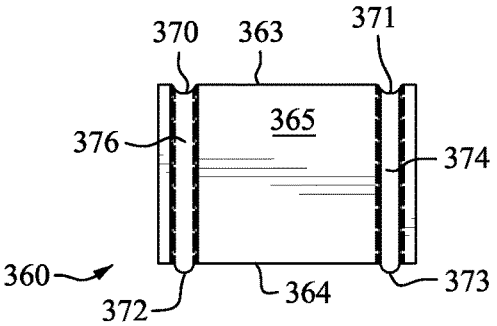
Figures 3, 6E:
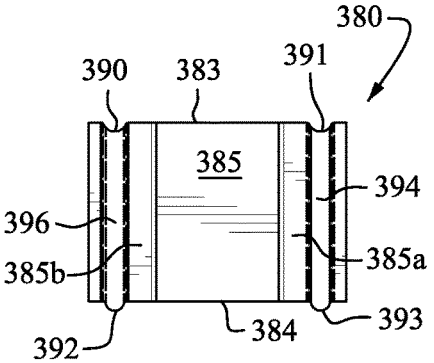
Figure 7:
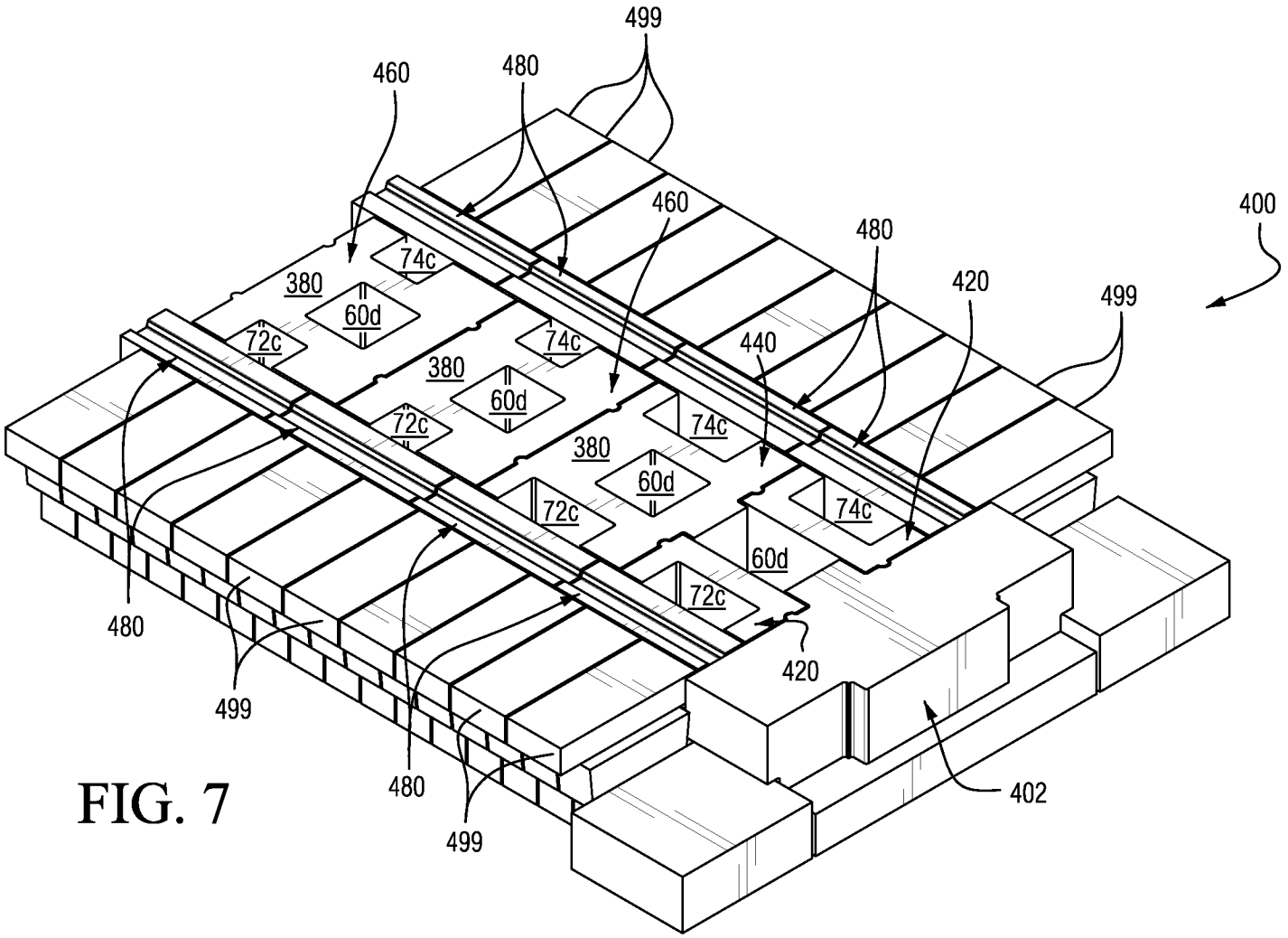
Figures 1, 7A:
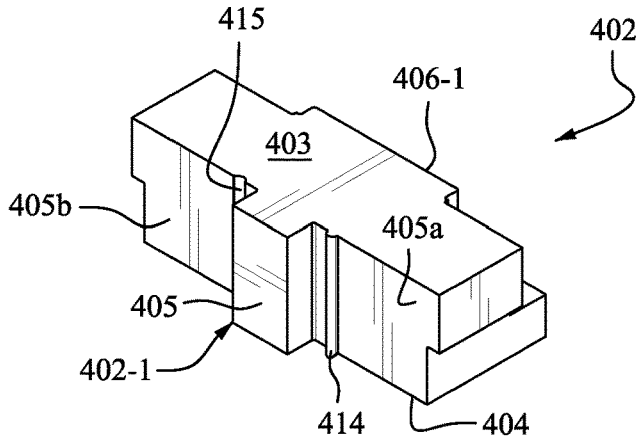
Figures 2, 7A:
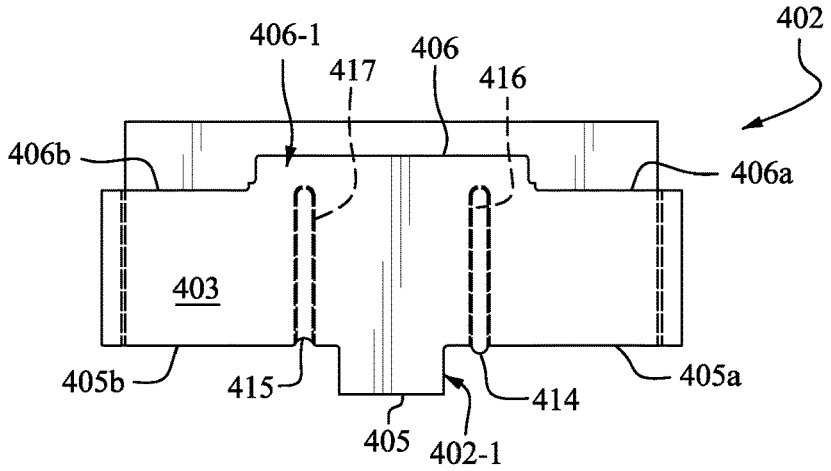
Figures 3, 7A:
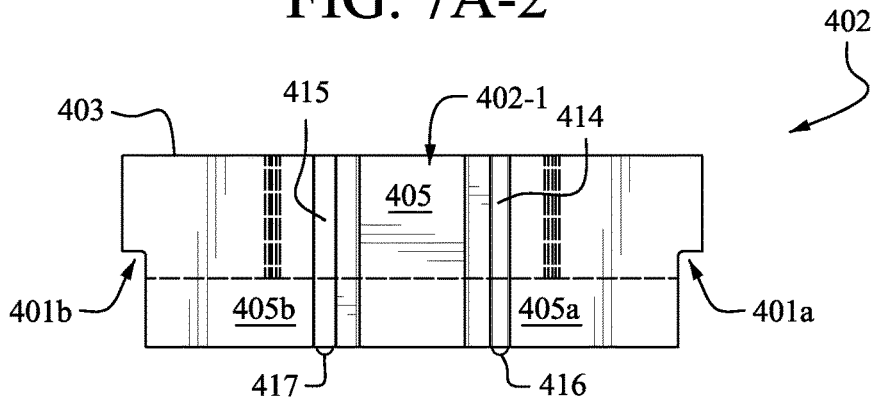
Figures 1, 7B:
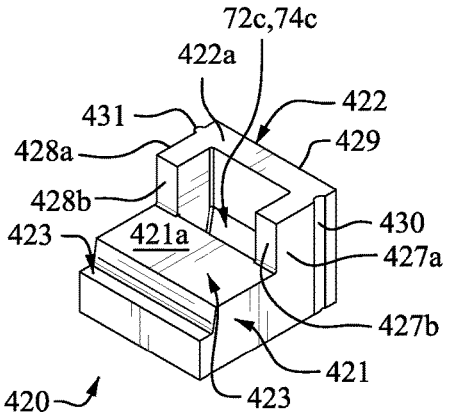
Figures 2, 7B:
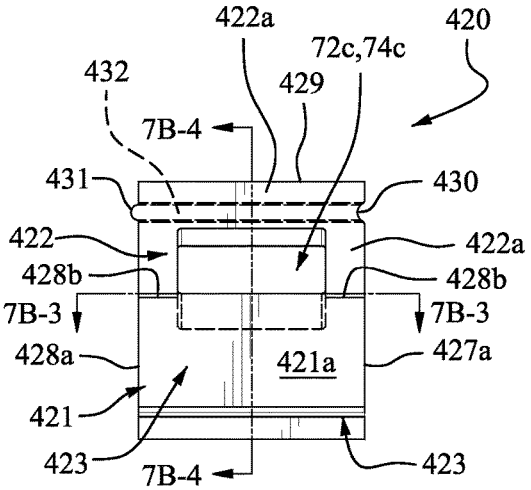
Figures 3, 7B:
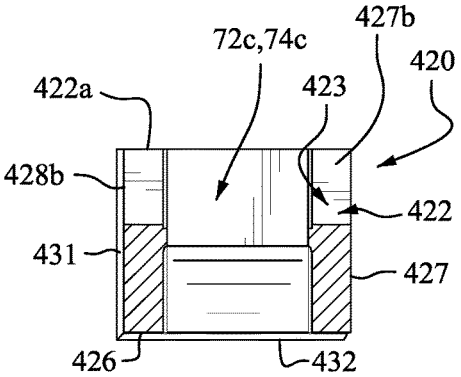
Figures 4, 7B:
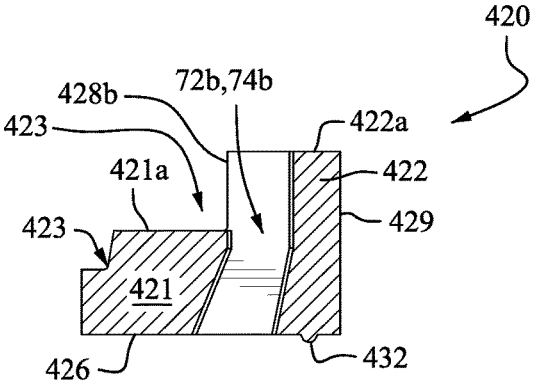
Figures 1, 7C:
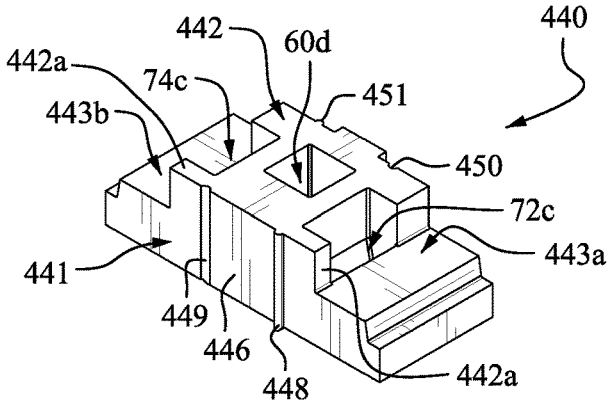
Figures 2, 7C:
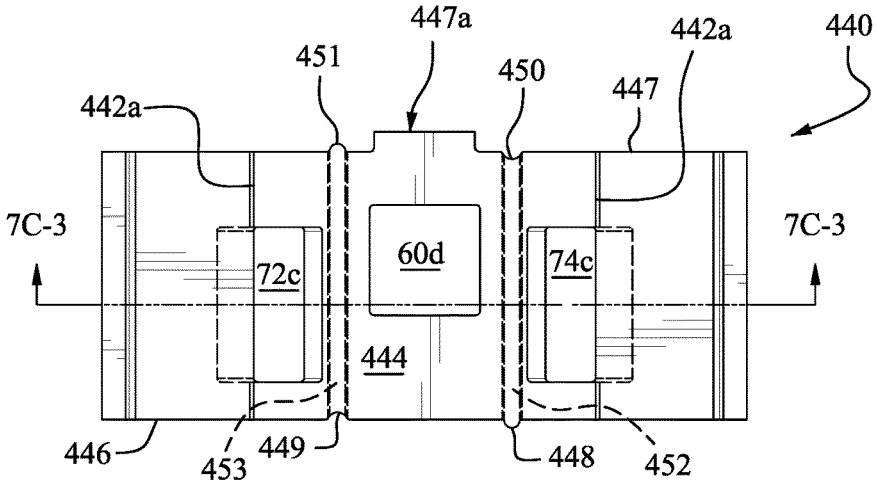
Figures 3, 7C:
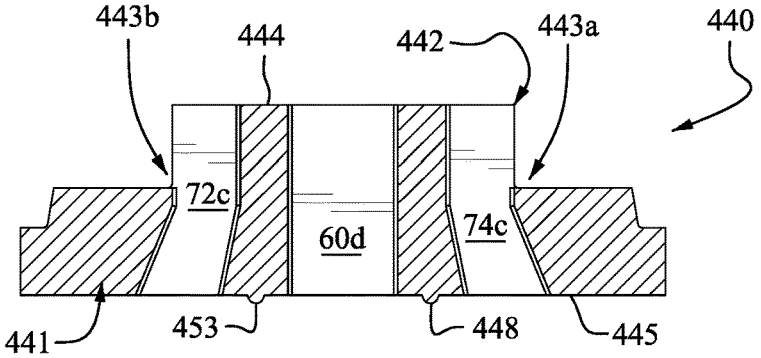
Figures 1, 7D:
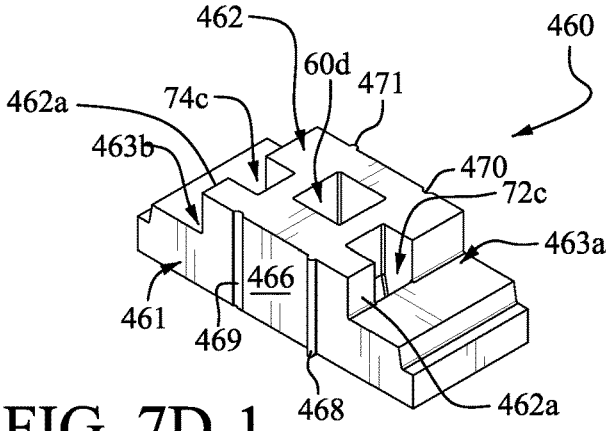
Figures 2, 7D:
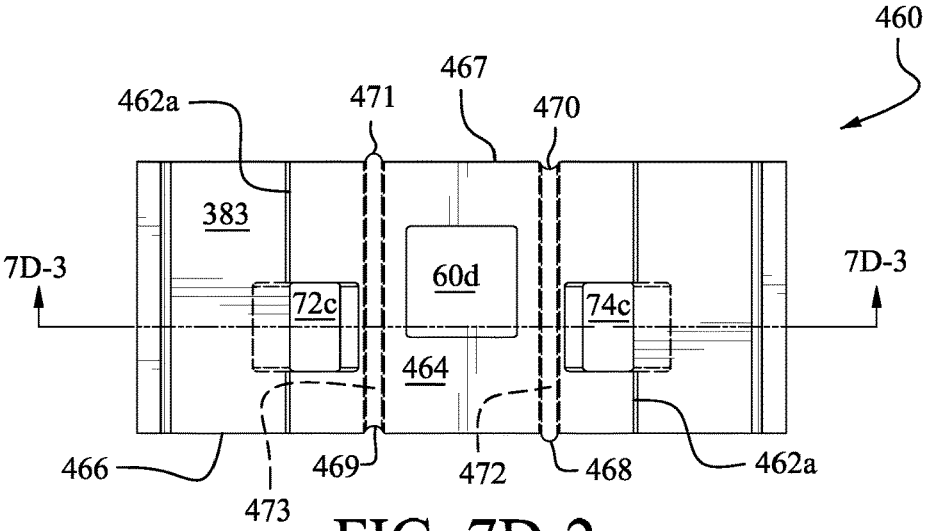
Figures 3, 7D:
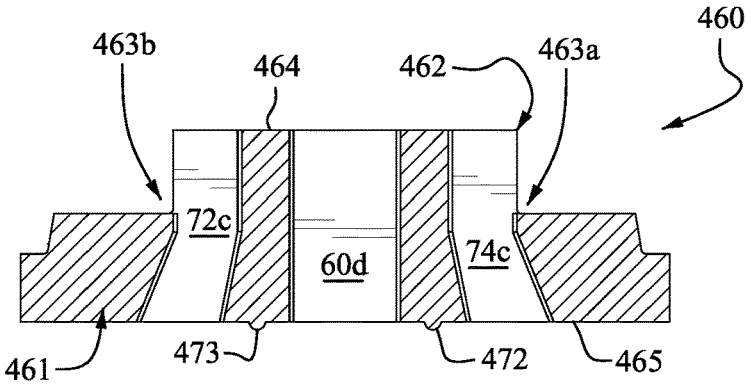
Figures 1, 7E:
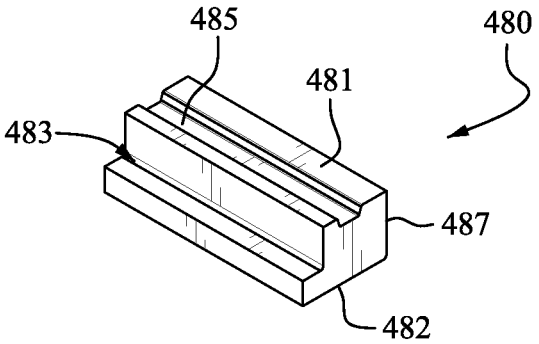
Figures 2, 7E:
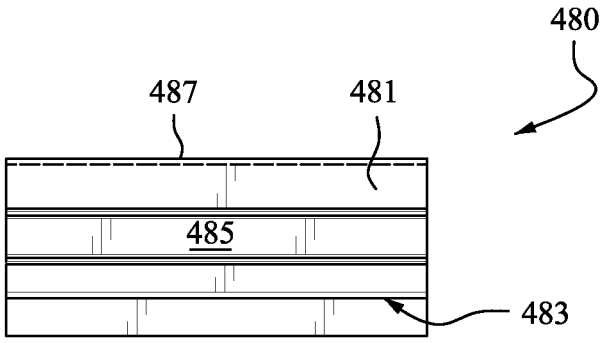
Figures 3, 7E:
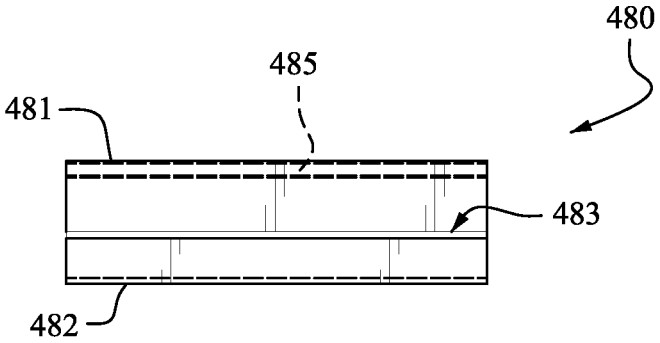

FIGS. 6B-1 through 6B-4 show a first lateral flue block associated with the third tier of blocks forming the corbel structure, wherein FIG. 6B-1 is a perspective view thereof, FIG. 6B-2 is a top plan view thereof, FIG. 6B-3 is a latitudinal cross-sectional elevational view thereof taken along line 6B-3 in FIG. 6B-2 and FIG. 6B-4 is a longitudinal cross-sectional view thereof taken along line 6B-4 in FIG. 6B-2;

FIGS. 6C-1 through 6C-4 show a second lateral flue block associated with the third tier of blocks forming the corbel structure, wherein FIG. 6C-1 is a perspective view thereof, FIG. 6C-2 is a top plan view thereof, FIG. 6C-3 is a latitudinal cross-sectional elevational view thereof taken along line 6C-3 in FIG. 6C-2 and FIG. 6C-4 is a longitudinal cross-sectional view thereof taken along line 6C-4 in FIG. 6C-2;

FIGS. 6D-1 through 6D-3 show a first type of spacer block associated with the third tier of blocks forming the corbel structure, wherein FIG. 6D-1 is a perspective view thereof, FIG. 6D-2 is a top plan view thereof, and FIG. 6D-3 is a front elevational view thereof;

FIGS. 6E-1 through 6E-3 show a second type of spacer block associated with the third tier of blocks forming the corbel structure, wherein FIG. 6D-1 is a perspective view thereof, FIG. 6D-2 is a top plan view thereof, and FIG. 6D-3 is a front elevational view thereof;

FIG. 7 is an enlarged perspective assembled view of the fourth tier of blocks forming the corbel structure;

FIGS. 7A-1 through 7A-3 show an end block associated with the fourth tier of blocks forming the corbel structure, wherein FIG. 7A-1 is a perspective view thereof, FIG. 7A-2 is a top plan view thereof and FIG. 7A-3 is a front elevational view thereof;

FIGS. 7B-1 through 7B-4 show a lateral flue block associated with the fourth tier of blocks forming the corbel structure, wherein FIG. 7B-1 is a perspective view thereof, FIG. 7B-2 is a top plan view thereof, FIG. 7B-3 is a longitudinal cross-sectional elevational view thereof taken along line 7B-3 in FIG. 7B-2 and FIG. 7B-4 is a latitudinal cross-sectional view thereof taken along line 7B-4 in FIG. 7B-2;

FIGS. 7C-1 through 7C-3 show a first spanner flue block associated with the fourth tier of blocks forming the corbel structure, wherein FIG. 7C-1 is a perspective view thereof, FIG. 7C-2 is a top plan view thereof, and FIG. 7C-3 is a cross-sectional elevational view thereof as taken along line 7C-3 in FIG. 7C-2;

FIGS. 7D-1 through 7D-3 show a second spanner flue block associated with the fourth tier of blocks forming the corbel structure, wherein FIG. 7D-1 is a perspective view thereof, FIG. 7D-2 is a top plan view thereof, and FIG. 7D-3 is a cross-sectional elevational view thereof as taken along line 7D-3 in FIG. 7D-2; and FIGS. 7E-1 through 7E-3 show a lateral spacer block associated with the fourth tier of blocks forming the corbel structure, wherein FIG. 7E-1 is a perspective view thereof, FIG. 7E-2 is a top plan view thereof, and FIG. 7E-3 is a front elevational view thereof.

DETAILED DESCRIPTION

Figure 2A:
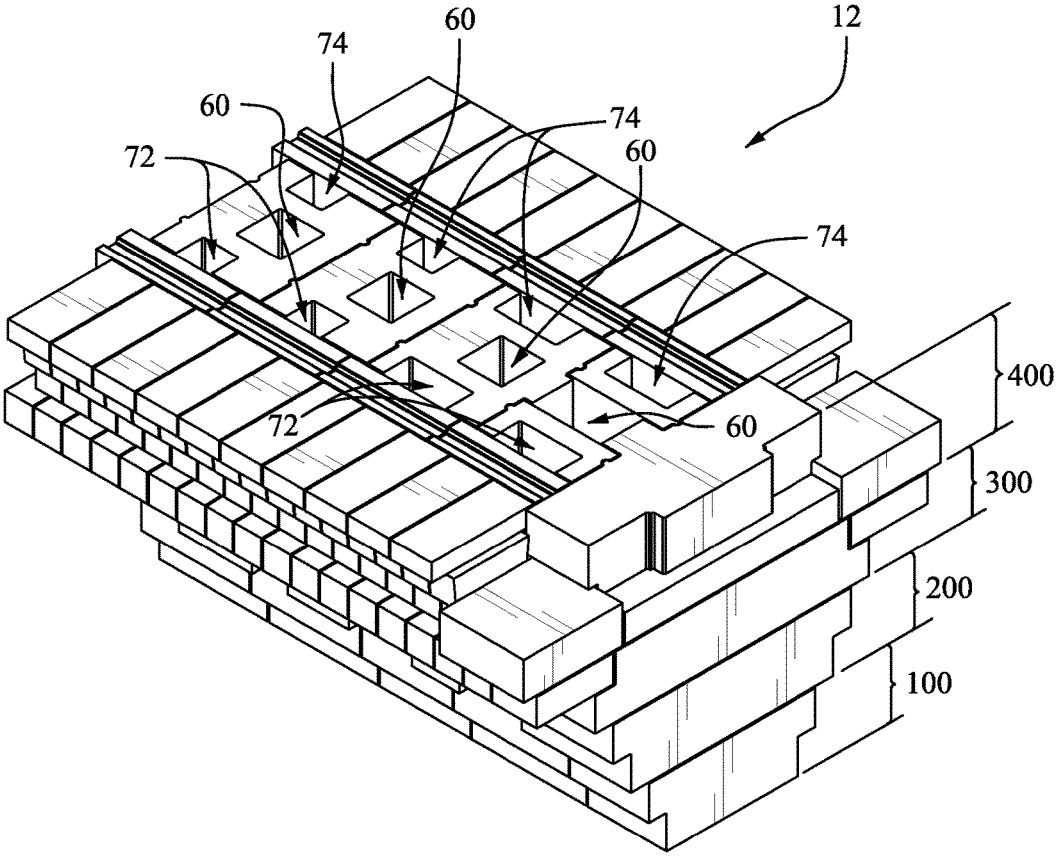
FIG. 2A is a perspective view showing just the corbel structure depicted in FIG. 1.
Figure 2B:
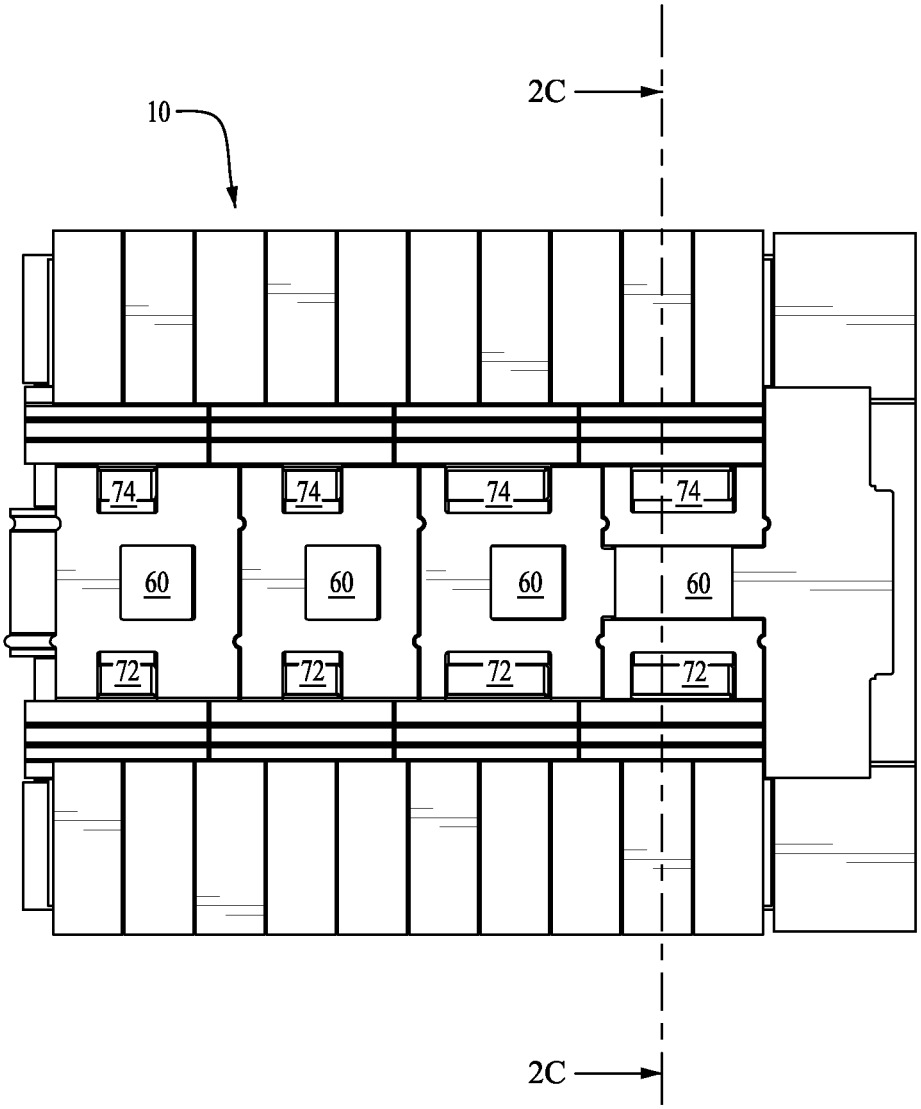
FIG. 2B is a top plan view of the corbel structure shown in FIG. 2A.
Figure 2C:
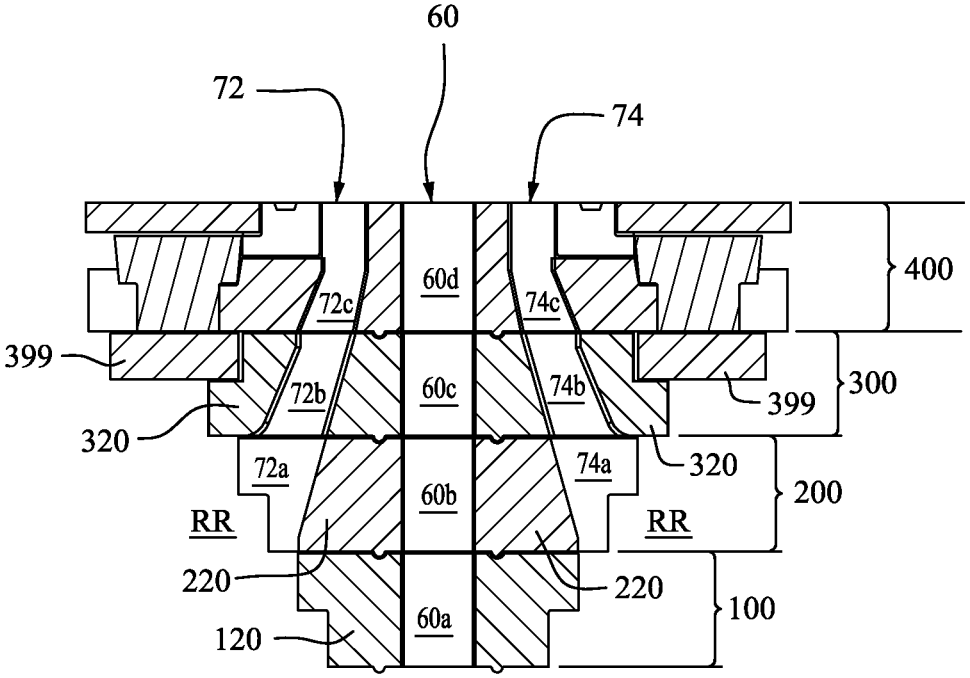
FIG. 2C is a cross-sectional elevational view of the corbel structure shown in FIG. 2A as taken along lines 2C-2C in FIG. 2B.

Accompanying FIG. 1 shows an exemplary corbel structure 10 in accordance with an embodiment of the present invention supported on a pier P associated with a coke oven battery. In this regard, it will be understood that a conventional coke oven battery will include a number of spaced apart piers P, each supporting a corbel structure 10 and defining therebetween regenerator regions RR (see FIG. 2C) provided with checker bricks (not shown). The corbel structures 10 in turn support the refractory walls and floors of the individual coke ovens (not shown).

FIGS. 2A-2C and 3 show in greater detail the components of the corbel structure 10. In this regard it will be observed that the corbel structure 10 is comprised of essentially four courses 20, 30, 40 and 50 (see FIG. 2C) assembled from especially configured refractory blocks (to be described in greater detail below) which are stacked one on top of another. The courses 100, 200, 300 and 400 collectively define central substantially vertically oriented flues 60 and lateral substantially diagonally oriented flues 72, 74 which communication with corresponding flues within the walls of the coke oven walls (not shown) to allow for the burning of air and gas therein and the transport of heated waste gas to and from the regenerator regions.

FIG. 4 is a perspective assembled view of the interconnected refractory blocks forming the first tier 100 of the corbel structure, with FIGS. 4A-1 through 4D-3 showing respective views of the individual refractory blocks thereof. In this regard, FIGS. 4A-1 through 4A-3 depict the end block 102 of the first tier 100. As shown, the end block 102 is a generally T-shaped block having opposed top and bottom faces 103, 104 respectively, and opposed front and rear faces 105, 106, respectively, which are substantially mutually orthogonal to the top and bottom faces 103, 104 thereby defining respective parallel pairs of upper and lower edges 107, 108 and 109, 110.

The top face 103 includes a parallel pair of elongate substantially horizontal elongate recessed grooves 112, 113. The front face 105 includes an elongate substantially vertical elongate protruding tongue 114 and a substantially vertical recessed groove 115. The bottom face 106 includes a parallel pair of substantially horizontal elongate protruding tongues 116, 117. It will be observed that the groove 112 and tongue 114 include respective adjacent ends that co-terminate at the edge 107 of the mutually orthogonal faces 103 and 105. Similarly, the groove 115 and tongue 117 include respective adjacent ends that co-terminate at the edge 109 of the mutually orthogonal faces 104 and 105. Grooves 113, 115 on the one hand and tongues 114, 116 on the other hand have respective ends that co-terminate at the edges 107 and 109 of the mutually orthogonal pairs of faces 103, 105 and 104, 105, respectively.

Figures 1, 4B:
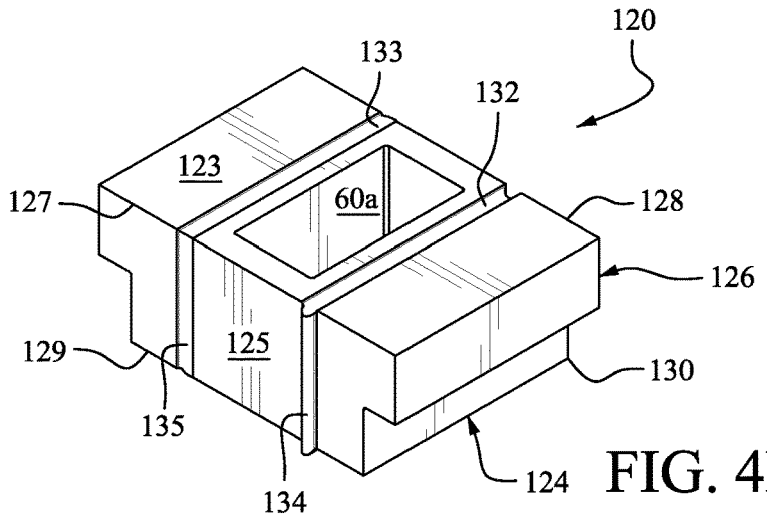
Figures 2, 4B:
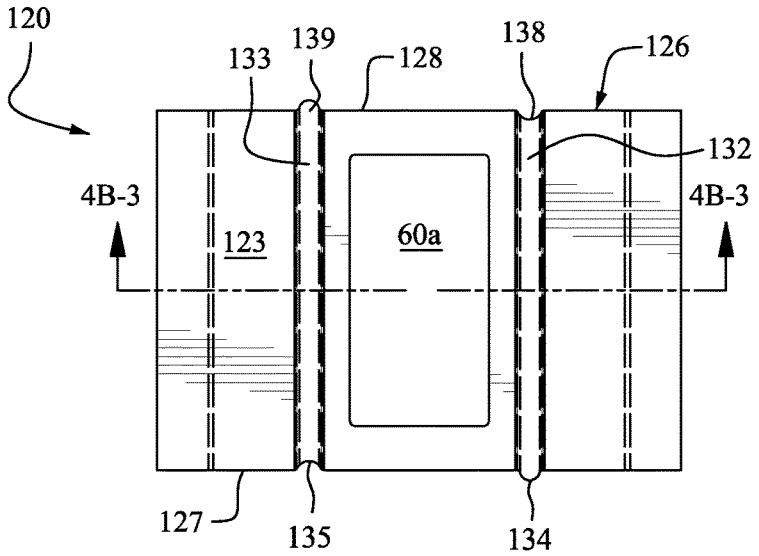
Figures 3, 4B:
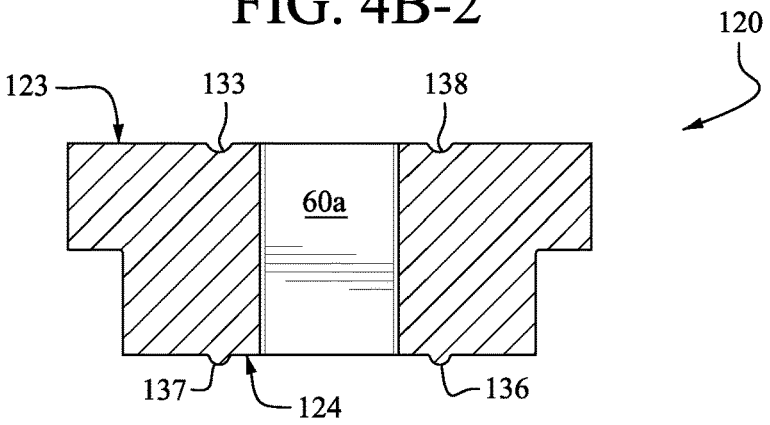

FIGS. 4B-1 through 4B-3 show a first flue block 120 associated with the first tier 100 of blocks forming the corbel structure 12. As shown, the first flue block 120, like the end block 102, is a corresponding generally T-shaped block which defines a substantially vertical flue section **60*a*. The flue section 60*a* is substantially a rectangular shaped opening when viewed in plan which is symmetrically positioned with respect to the longitudinal and latitudinal axes of the block 120**.

The flue block 120 has opposed top and bottom faces 123, 124 respectively, and opposed front and rear faces 125, 126, respectively, which are substantially mutually orthogonal to the top and bottom faces 123, 124 thereby defining respective parallel pairs of upper and lower edges 127, 128 and 129, 130.

The top face 123 includes a parallel pair of elongate substantially horizontal elongate recessed grooves 132, 133. The front face 125 includes an elongate substantially vertical elongate protruding tongue 134 and a substantially vertical recessed groove 135 parallel with the groove 134. The bottom face 124 includes a parallel pair of substantially horizontal elongate protruding tongues 136, 137. The rear face 126 includes an elongate substantially vertical elongate protruding tongue 138 and a substantially vertical recessed groove 139 parallel with the groove 138.

It will be observed that the groove 132 and tongue 134 include respective adjacent ends that co-terminate at the edge 127 of the mutually orthogonal faces 123 and 125. Similarly, the groove 135 and tongue 137 include respective adjacent ends that co-terminate at the edge 129 of the mutually orthogonal faces 124 and 125. Grooves 133, 135 on the one hand and tongues 134, 136 on the other hand have respective ends that co-terminate at the edges 127 and 129 of the mutually orthogonal pairs of faces 123, 125 and 124, 125, respectively. The groove 138 and tongue 139 include respective adjacent ends that respectively co-terminate at the edge 128 of the mutually orthogonal faces 123 and 126 with the grooves 132, 133.

It will be seen in FIG. 4 that the parallel grooves 112, 113 of the block 102 longitudinally align with the grooves 132, 133, respectively of the block 120. In addition, the groove 138 and tongue 139 formed on the rear face 126 of the block 120 will be correspondingly mated with the tongue 114 and the groove 115 formed on the front face of the end block 102 so as to provide locking interconnection therebetween.

Figures 1, 4C:
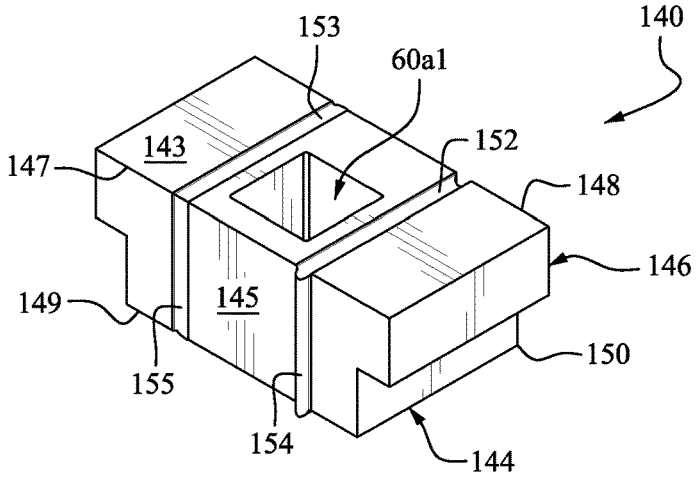
Figures 2, 4C:
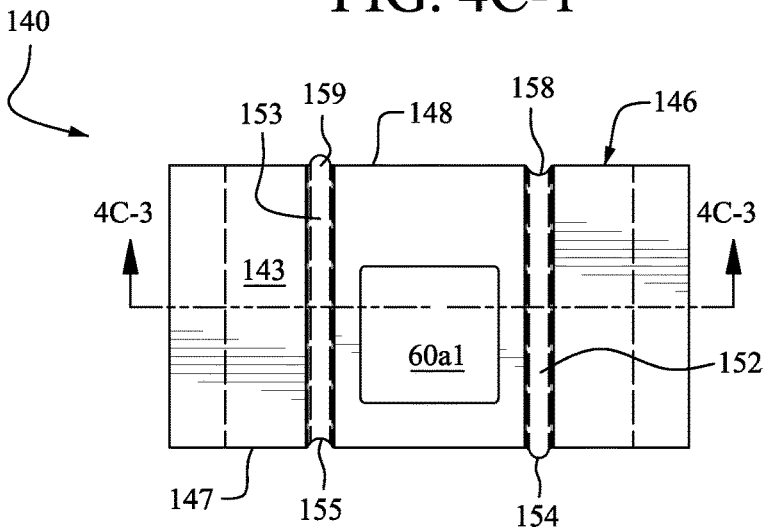
Figures 3, 4C:
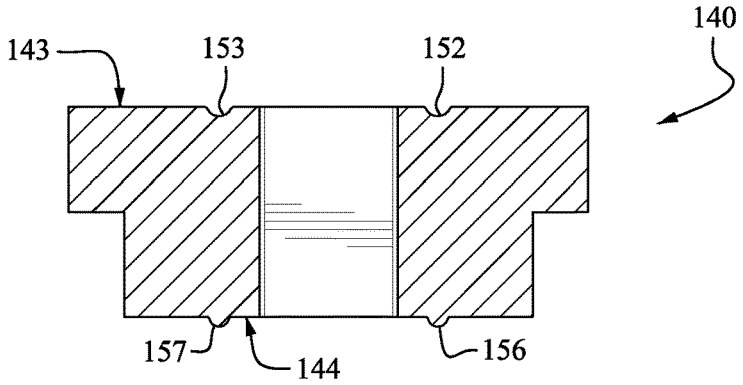

FIGS. 4C-1 through 4C-3 show a second flue block 140 associated with the first tier 100 of blocks forming the corbel structure 12. As shown, the second flue block 140, like the end block 102 and first flue block 120, is a corresponding generally T-shaped block which defines a substantially vertical flue section 60*a*1. The flue section 60*a*1 is a substantially square-shaped opening as viewed in plan and is asymmetrically off-set with respect to the longitudinal centerline of the block 140 but symmetrically oriented with respect to the latitudinal centerline thereof.

The flue block 140 has opposed top and bottom faces 143, 144 respectively, and opposed front and rear faces 145, 146, respectively, which are substantially mutually orthogonal to the top and bottom faces 143, 144 thereby defining respective parallel pairs of upper and lower edges 147, 148 and 149, 150.

The top face 143 includes a parallel pair of elongate substantially horizontal elongate recessed grooves 152, 153. The front face 145 includes an elongate substantially vertical elongate protruding tongue 154 and a substantially vertical recessed groove 155 parallel with the groove 154. The bottom face 144 includes a parallel pair of substantially horizontal elongate protruding tongues 156, 157. The rear face 146 includes an elongate substantially vertical elongate protruding tongue 158 and a substantially vertical recessed groove 159 parallel with the groove 158.

It will be observed that the groove 152 and tongue 154 include respective adjacent ends that co-terminate at the edge 147 of the mutually orthogonal faces 143 and 145. Similarly, the groove 155 and tongue 157 include respective adjacent ends that co-terminate at the edge 149 of the mutually orthogonal faces 144 and 145. Grooves 153, 155 on the one hand and tongues 154, 156 on the other hand have respective ends that co-terminate at the edges 147 and 149 of the mutually orthogonal pairs of faces 143, 145 and 144, 145, respectively. The groove 158 and tongue 159 include respective adjacent ends that respectively co-terminate at the edge 148 of the mutually orthogonal faces 143 and 146 with the grooves 152, 153.

It will be seen in FIG. 4 that the parallel grooves 132, 133 of the block 120 longitudinally align with the grooves 152, 153, respectively, of the block 140. In addition, the groove 158 and tongue 159 formed on the rear face 146 of the block 140 will be correspondingly mated with the tongue 134 and the groove 135 formed on the front face of the block 120 so as to provide locking interconnection therebetween.

Figures 1, 4D:
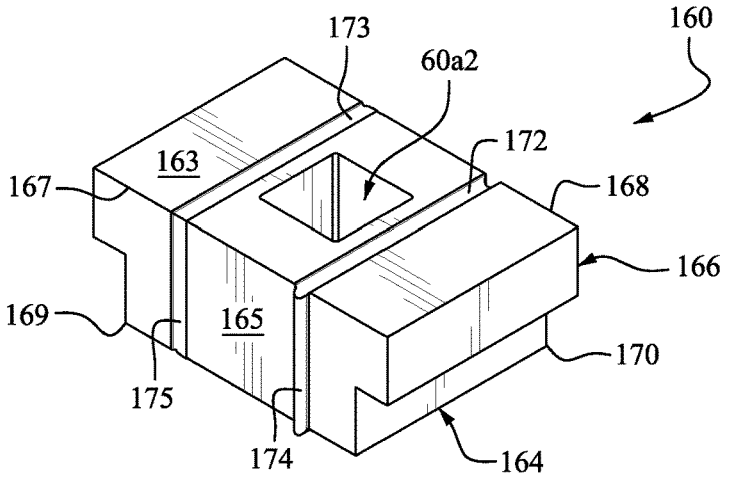
Figures 2, 4D:
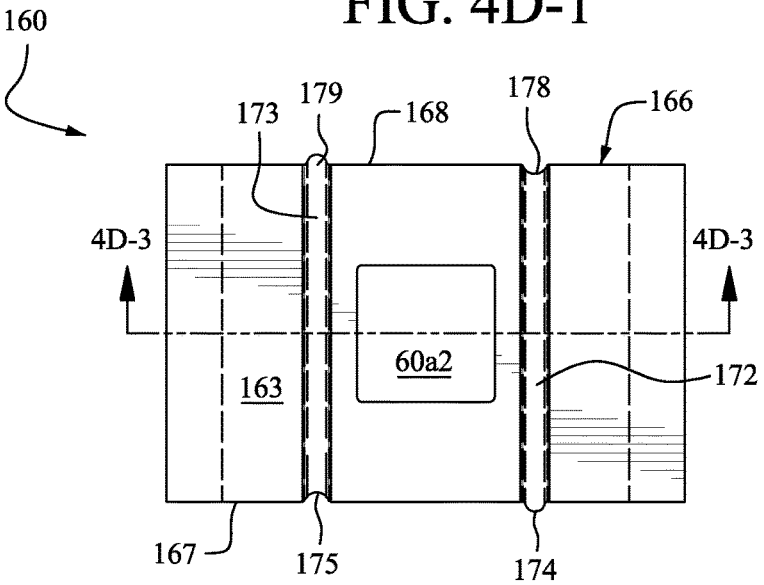
Figures 3, 4D:
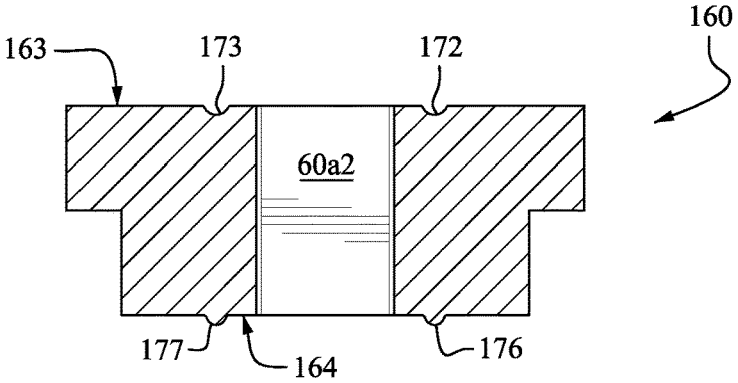

FIGS. 4D-1 through 4D-3 show a third flue block 160 associated with the first tier 100 of blocks forming the corbel structure 12. As shown, the third flue block 160, like the blocks 102, 120 and 140 as described previously, is a corresponding generally T-shaped block which defines a substantially vertical flue section 60*a*1. The flue section 60*a*2 is a substantially square-shaped opening as viewed in plan which is symmetrically oriented with respect to both the longitudinal and latitudinal centerlines of the block 160.

The flue block 160 has opposed top and bottom faces 163, 144 respectively, and opposed front and rear faces 165, 166, respectively, which are substantially mutually orthogonal to the top and bottom faces 163, 164 thereby defining respective parallel pairs of upper and lower edges 167, 168 and 169, 170.

The top face 163 includes a parallel pair of elongate substantially horizontal elongate recessed grooves 172, 173. The front face 165 includes an elongate substantially vertical elongate protruding tongue 174 and a substantially vertical recessed groove 175 parallel with the groove 174. The bottom face 164 includes a parallel pair of substantially horizontal elongate protruding tongues 176, 177. The rear face 166 includes an elongate substantially vertical elongate protruding tongue 178 and a substantially vertical recessed groove 179 parallel with the groove 178.

It will be observed that the groove 172 and tongue 174 include respective adjacent ends that co-terminate at the edge 167 of the mutually orthogonal faces 163 and 165. Similarly, the groove 175 and tongue 177 include respective adjacent ends that co-terminate at the edge 169 of the mutually orthogonal faces 164 and 165. Grooves 173, 175 on the one hand and tongues 174, 176 on the other hand have respective ends that co-terminate at the edges 167 and 169 of the mutually orthogonal pairs of faces 163, 165 and 164, 165, respectively. The groove 178 and tongue 179 include respective adjacent ends that respectively co-terminate at the edge 168 of the mutually orthogonal faces 163 and 166 with the grooves 172, 173.

It will be seen in FIG. 4 that the parallel grooves 152, 153 of the block 140 longitudinally align with the grooves 172, 173, respectively, of the block 160. In addition, the groove 178 and tongue 179 formed on the rear face 166 of the block 160 will be correspondingly mated with the tongue 154 and the groove 155 formed on the front face of the block 140 so as to provide locking interconnection therebetween.

Figure 5:
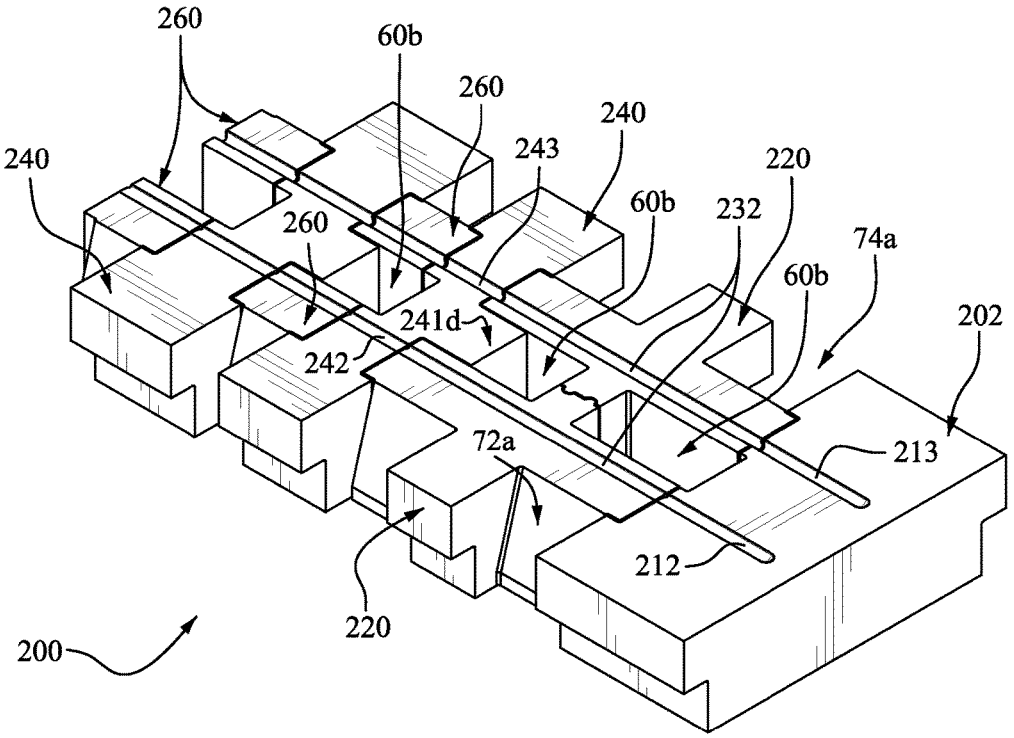
FIG. 5 is an enlarged perspective assembled view of the second tier of blocks forming the corbel structure.
Figures 1, 5A:
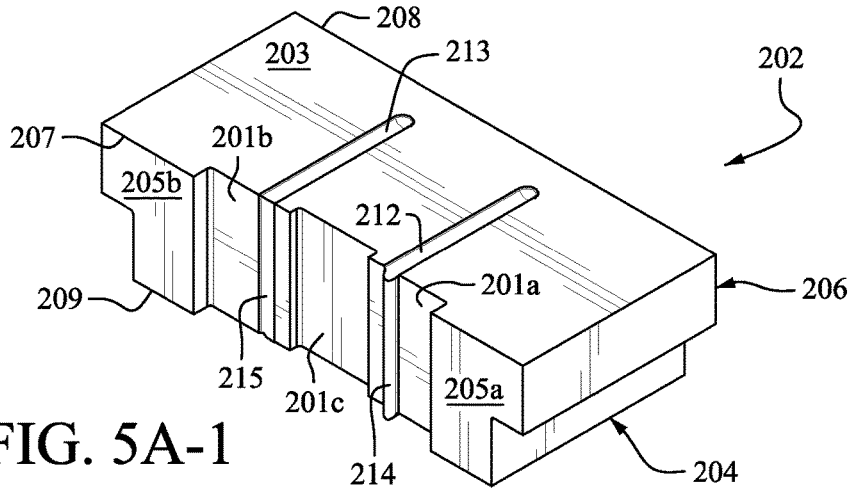
Figures 2, 5A:
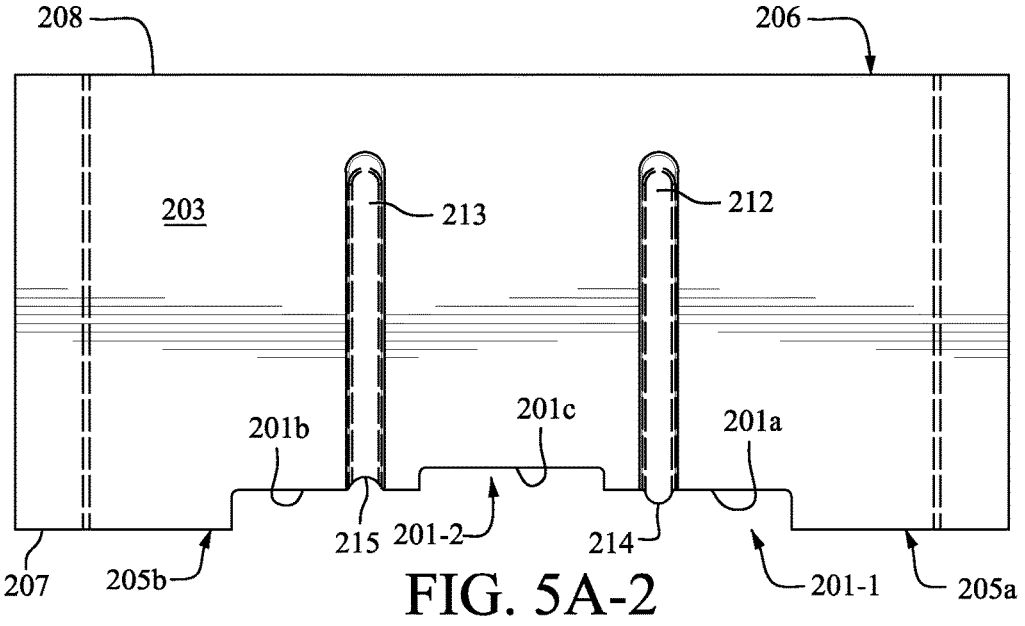
Figures 3, 5A:
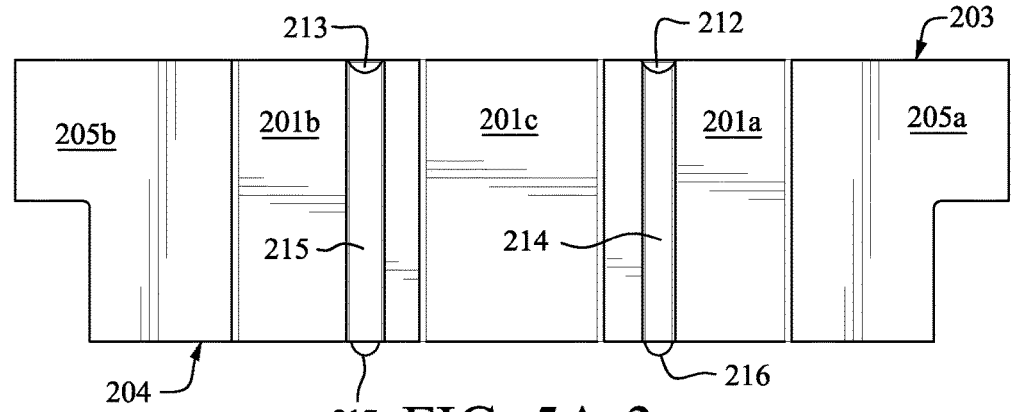

FIG. 5 is a perspective assembled view of the interconnected refractory blocks forming the second tier 200 of the corbel structure, with FIGS. 5A-1 through 5D-3 showing respective views of the individual refractory blocks thereof. In this regard, FIGS. 5A-1 through 5A-3 depict the end block 202 of the second tier 200. As shown, the end block 202 is a generally T-shaped block having opposed top and bottom faces 203, 204 respectively. A pair of front faces 205*a*, 205*b* and a rear face 206 are substantially mutually orthogonal to the top and bottom faces 203, 204 thereby defining respective parallel pairs of upper and lower edges 207, 208 and 209, 210.

The block 202 includes a reentrant section between the front faces 205*a*, 205*b* which defines a first recess 201-1 having lateral substantially planar recessed front faces 201*a*, 201*b* and a second recess 201-2 having a central substantially planar recessed face 201*c*. Each of the faces 201*a*-201*c* is mutually orthogonal with the planar top face 203 so as to establish respective edges therewith.

The top face 203 includes a parallel pair of elongate substantially horizontal elongate recessed grooves 212, 213. The front face 201*a* includes an elongate substantially vertical elongate protruding tongue 214 while the front face 201*b* includes a substantially vertical recessed groove 215. The bottom face 206 includes a parallel pair of substantially horizontal elongate protruding tongues 216, 217. It will be observed that the groove 212 and tongue 214 include respective adjacent ends that co-terminate at the respective edges formed by the top face 203 with each of the recessed front faces 201*a*, 201*b* mutually orthogonal therewith. Similarly, the groove 215 and tongue 217 include respective adjacent ends that co-terminate at the edges of the recessed front faces 201*a*, 201*b* which each forms with the mutually orthogonal bottom face 204. Tongues 212 and 214 have respective ends that co-terminate at the edge formed between the mutually orthogonal bottom face 204 and the recessed front face 201*a*, while grooves 213 and 215 have respective ends that co-terminate at the edge formed between the mutually orthogonal top face 203 and the recessed front face 201*b*.

Figures 1, 5B:
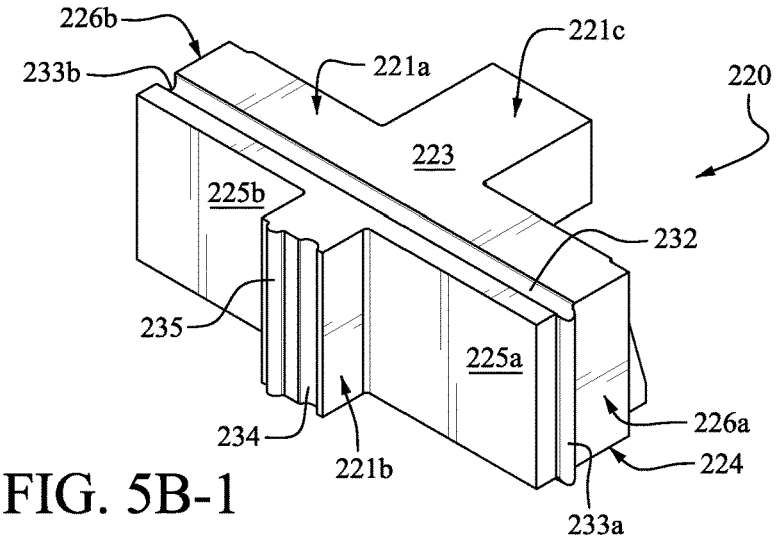
Figures 2, 5B:
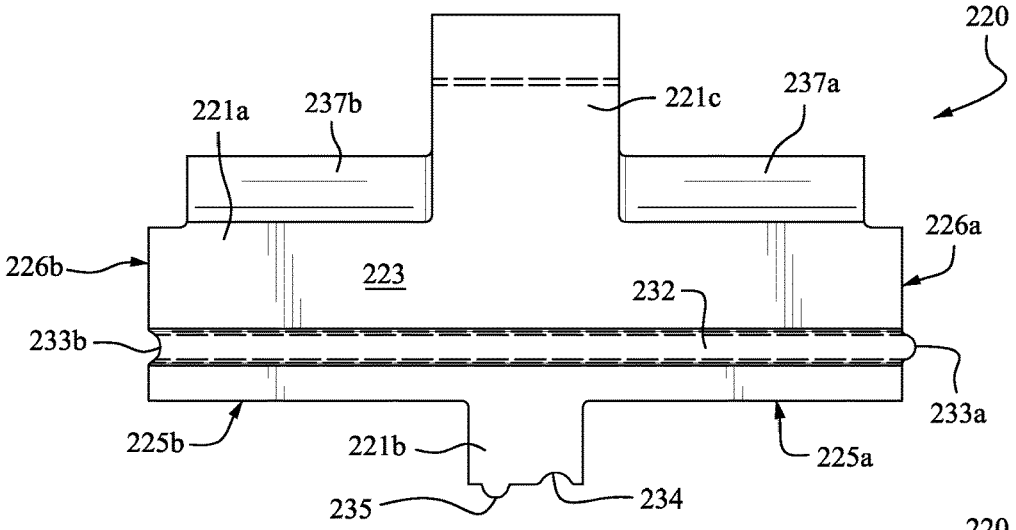
Figures 3, 5B:
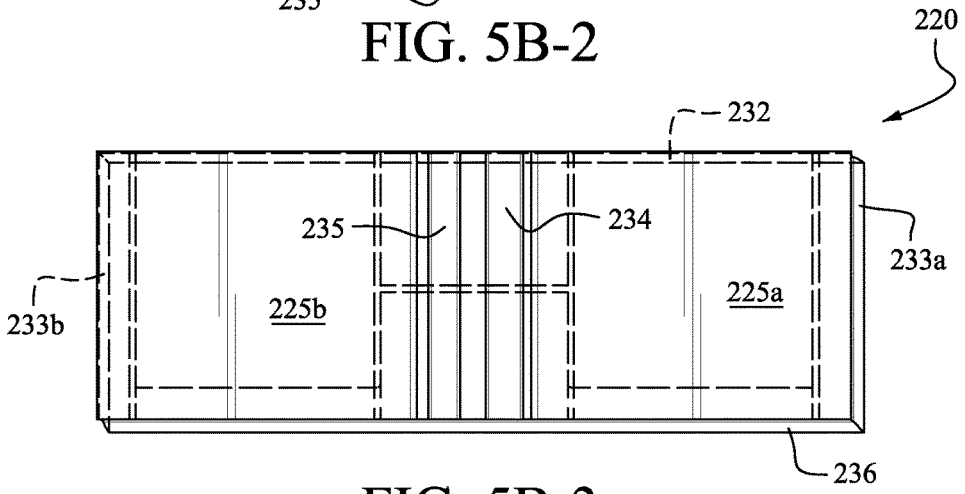

As is shown in FIG. 5, the second tier 200 of refractory blocks forming the corbel 12 includes an opposed mirror image pair of generally cruciform-shaped blocks 220, a representative one of which is shown in FIGS. 5B-1 through 5B-3. As depicted, each of the blocks 220 includes an elongate central section 221*a*, an inwardly projecting leg section 221*b* and an outwardly projecting leg section 221*c* each being substantially perpendicular to the central section 221*a*. The top face 223 of the central section is mutually orthogonal to the respective front faces 225*a* and 225*b* which are separated by the inwardly projecting leg section 221*b*. The central section 221 of the block 220 also has an opposed pair of end faces 226*a*, 226*b* that are mutually orthogonal to each of the top and bottom faces 223 and 224, respectively. The top face 223 defines an elongate groove 232 while each of the opposed end faces 226*a*, 226*b* defines a respective tongue 233*a* and groove 233*b*, respectively.

The inwardly projecting leg 221*b* includes substantially vertically oriented and parallel elongate groove 234 and tongue 235. The bottom surface 224 includes an outwardly projecting elongate substantially horizontal tongue 236. The grooves 232 and 233*b* on the one hand and the grooves 233*a*, 236 on the one hand are joined in an end-to-end manner so as to essentially bound the longitudinal extent of the elongate central section 221*a* of the block 220. That is, the horizontal groove 232 and the vertical tongue 233*a* have respective ends that co-terminate at the edge formed between the mutually orthogonal top face 223 and the end face 226*a* while the horizontal groove 232 and vertical groove 233*b* have respective ends that co-terminate at the edge formed between the mutually orthogonal top face 223 and the end face 226*b*. The horizontal tongue 236 has opposed ends that co-terminate with a respective end of each of the vertical grooves 233*a* and 233*b* formed in the horizontal side faces 226*a* and 226*b*, respectively.

The lateral side of the block 220 includes a pair of downwardly and outwardly sloped surfaces 237*a*, 237*b* on each side of the outwardly projecting leg 221*c*. Each of the sloped surfaces 237*a*, 237*b* defines a lowermost section 72*a*, 74*a* of the lateral flues 72, 74, respectively (see FIG. 2C), in dependence on the positioning of the block 220 within the second tier 200. In addition, it will be observed that when an opposed pair of the blocks 220 are interconnected with one another (e.g., by engagement of the respective tongues 235 with the opposed grooves 234 of section 221*b*) the opposed front faces 225*a* and 225*b* thereof will define a section 60*b* of the central flue 60 (see FIG. 2C).

As shown in FIG. 5, the interconnected opposed pair of blocks 220 will in turn be interconnected to the end block 202 by virtue of the tongue 233*a* and groove 233*b* of the opposed blocks 220 being engaged with the groove 215 and tongue 214 of the end block 202, respectively. In addition, the grooves 232 of the opposed blocks 220 will be longitudinally aligned with the grooves 212 and 213 of the end block 202.

The second tier 200 is also comprised of longitudinally separated transverse blocks 240 alternating with an opposed set of spacer blocks 260 (see FIG. 5). The transverse blocks 240 are shown in greater detail in accompanying FIGS. 5C-1 through 5C-3 while an exemplary one of the spacer blocks 260 is shown in greater detail in accompanying FIGS. 5D-1 through 5D-3.

Figures 1, 5C:
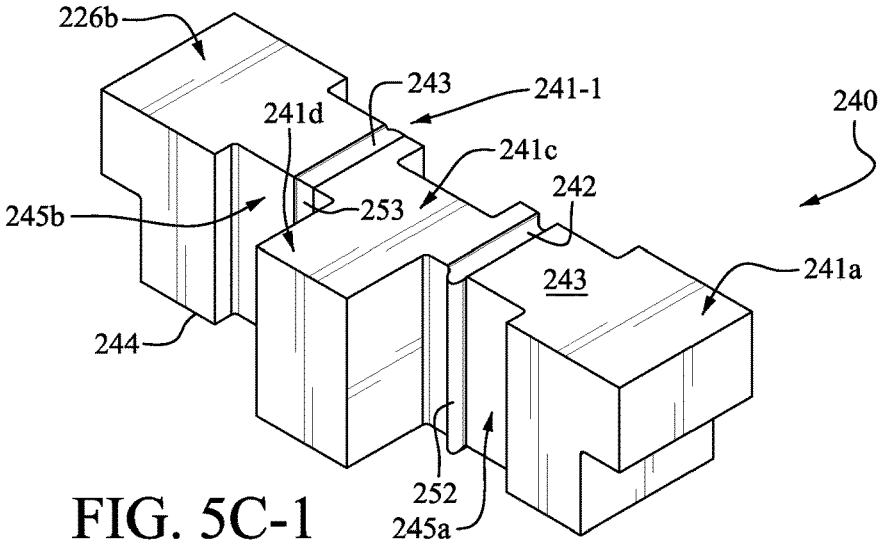
Figures 2, 5C:
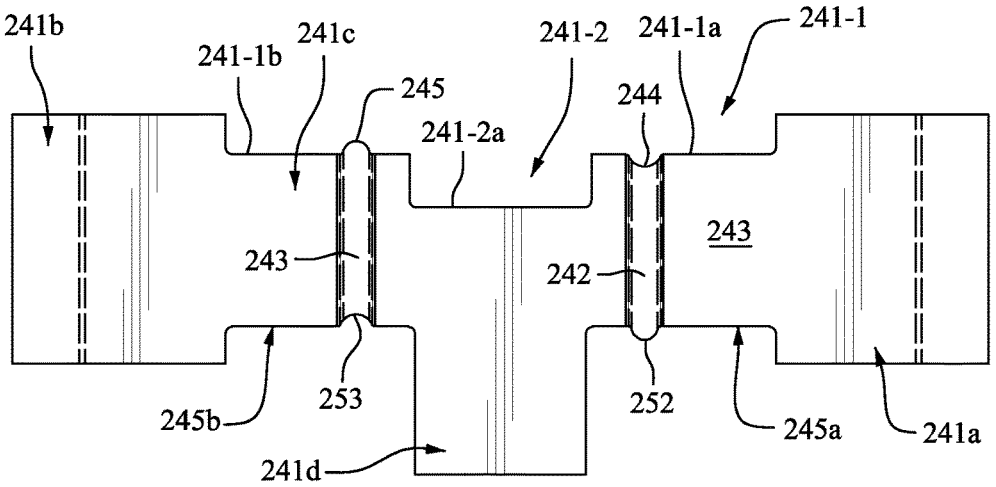
Figures 3, 5C:
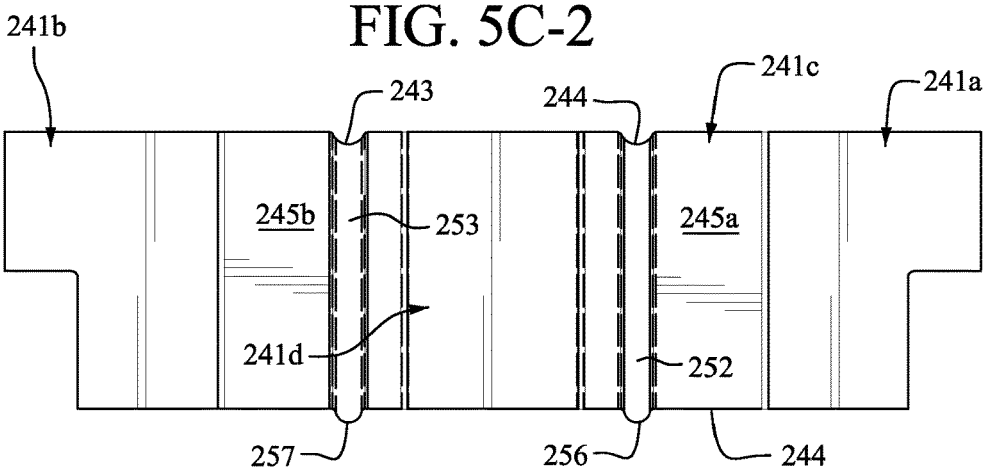
Figures 1, 5D:
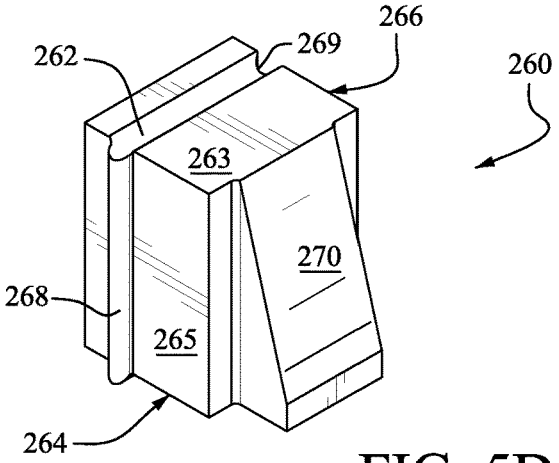
Figures 2, 5D:
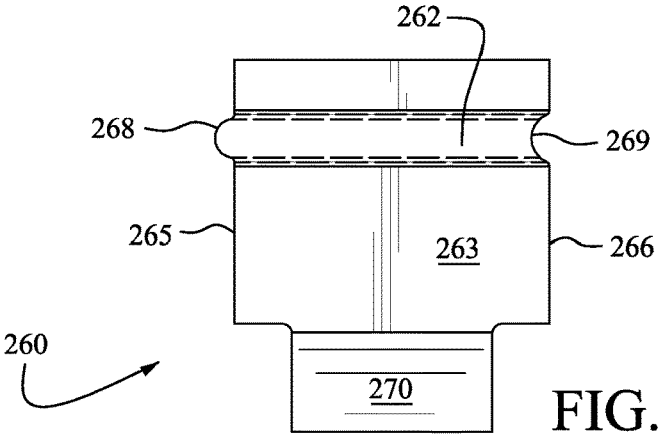
Figures 3, 5D:
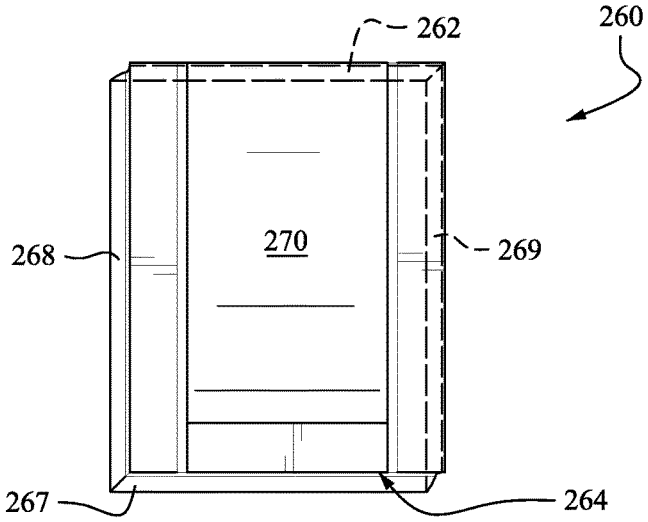

As is shown in FIGS. 5C-1 through 5C-3 is a generally I-shaped structure comprised of end sections 241*a*, 241*b* and a central section 241*c*. A boss section 241*d* protrudes outwardly from substantially the mid-region of the central section 241*c*. Each of end and central sections 241*a*, 241*b* and 241*c*, respectively, define collectively a substantially planar top face 243 and an opposed substantially planar bottom face 244 of the block 230.

The substantially vertical side of the block 240 opposite the boss 241*d* includes a reentrant section between the opposed end sections 241*a*, 241*b* which defines a first recess 241-1 having lateral substantially planar recessed rear faces 241-1*a*, 241-1*b* and a second recess 241-2 having a substantially planar recessed central face 241-2*a*. Each of the faces 241-1*a*, 241-1*b* and 241-1*c* is mutually orthogonal with the planar top face 243 so as to establish respective edges therewith.

The top face 243 includes a parallel pair of elongate substantially horizontal elongate recessed grooves 242, 243. The rear faces 241-1*a* and 241-1*b* respectively include an elongate substantially vertical recessed groove 245 and an elongate substantially vertical elongate protruding tongue 244. The bottom face 246 includes a parallel pair of substantially horizontal elongate protruding tongues 256, 257, respectively. It will be observed that the groove 242 and groove 244 include respective adjacent ends that co-terminate at the respective edge formed by the top face 243 with the rear face 241-1*a*, while the groove 243 and the tongue 245 include respective adjacent ends that co-terminate at the respective edge formed by the top face 242 and the rear face 241-1*b*.

A pair of separated front faces 245*a*, 245*b* are formed between the boss section 241*d* and the end sections 241*a*, 241*b*, respectively. The front face 245*a* includes a substantially vertical tongue 252 while the front face 245*b* includes a substantially vertical groove 253. The groove 242 and tongue 252 include respective adjacent ends that co-terminate at the edge of the recessed front face 245*a* and the top face 243 that is mutually orthogonal therewith. Similarly, the groove 243 and the groove 253 include respective adjacent ends that co-terminate at the edge of the recessed front face 245*b* and the top face 243 that is mutually orthogonal therewith. Tongues 252 and 256 have respective ends that co-terminate at the edge formed between the mutually orthogonal bottom face 244 and the recessed front face 245*a*, while groove 253 and tongue 257 have respective ends that co-terminate at the edge formed between the mutually orthogonal top face 203 and the recessed front face 245*b*.

As can be seen in FIG. 5, the block 240 is transversely positioned such that the boss 241*d* thereof extends between the faces 225*a*, 225*b* of an opposed pair of blocks 220 thereby defining therewith the central flue portion 60*b*. The terminal ends of the opposed pair of blocks 220 are received within the recess on each side of the section 241*d* so as to abut against the faces 245*a* and 245*b*. In such a manner, therefore, the tongue 252 of block 220 will be interconnected with groove 233*b* of one of the blocks 220 whereas the groove 253 of block 240 will be interconnected with the tongue 233*a* of the other of the blocks 220.

An exemplary spacer block 260 employed in the second tier 200 of refractory blocks is shown in FIGS. 5D1 through 5D-3. As shown, the spacer block 260 is comprised of an opposed pair of top and bottom surfaces 263, 264 which are mutually orthogonal an opposed pair of front and rear surfaces 265, 266, respectively. The lateral side of the block 260 includes a downwardly and outwardly sloped surface 270 which defines a lowermost section 72*a*, 74*a* of the lateral flues 72, 74, respectively (see FIG. 2C), in dependence upon the positioning of the block 26 within the second tier 200.

The top surface 263 defines an elongate groove 262, whereas the rear surface 264 defines an elongate tongue 267 parallel with groove 262. The front and rear surfaces 265, 266 respectively define elongate parallel tongue 268 and groove 269, respectively. Each of the groove 262 and the tongue 267 has opposed ends which co-terminate with respective ones of the opposed ends of the tongue 268 and groove 269 at edges formed by the mutually orthogonal top and bottom surfaces 263, 264 with the front and rear faces 265, 266, respectively.

It will be understood that the tongues 216, 217 of block 202, the tongues 236 of block 220, the tongues 256, 257 of block 240 and the tongue 267 of block 260 will be longitudinally aligned with one another when such blocks 202, 220, 240 and 260 are positioned to form the second tier 200. These tongues 216, 217, 256, 257 and 267 will additionally be interconnected with the corresponding aligned elongate grooves 112, 113, 132, 133, 152, 153, 172 and 173 of the blocks 102, 120, 140 and 160 of the subjacent first tier 100. In such a manner, therefore the first tier 100 and second tier 200 of refractory blocks are interconnected to one another.

FIG. 6 is a perspective assembled view of the interconnected refractory blocks forming the third tier 300 of the corbel structure 12, with FIGS. 6A-1 through 6D-3 showing respective views of the individual refractory blocks thereof. In this regard, FIGS. 6A-1 through 6A-3 depict the end block 302 of the third tier 300. As shown, the end block 302 is a generally inverted T-shaped block having opposed top and bottom faces 303, 304 respectively. A boss section 302-1 protrudes outwardly from the block 302 and includes a primary front face 305 which projects beyond but is parallel to the secondary front faces 305*a* and 305*b* on each side of the boss 302-1. Each of the faces 305, 305*a* and 305*b* is substantially vertically planar and parallel with respect to one another and with respect to the rear surface 206. In addition, each of the faces 305, 305*a* and 305*b* on the one hand and rear surface 306 on the other hand is substantially mutually orthogonal to the top and bottom faces 203, 204 thereby defining respective parallel pairs of edges. Each of the opposed ends of blocks 302 included opposed L-shaped steps 301*a*, 301*b*.

The top face 303 includes a parallel pair of elongate substantially horizontal elongate recessed grooves 312, 313. The front face 305 formed on the boss 302-1 includes an elongate substantially vertical elongate protruding tongue 314 and a substantially vertical recessed groove 315. The bottom face 306 includes a parallel pair of substantially horizontal elongate protruding tongues 316, 317. It will be observed that the groove 312 and tongue 314 include respective adjacent ends that co-terminate at the edge of the mutually orthogonal faces 303 and 305. Similarly, the groove 315 and tongue 317 include respective adjacent ends that co-terminate at the edge of the mutually orthogonal faces 304 and 305. Grooves 313, 315 on the one hand and tongues 314, 316 on the other hand have respective ends that co-terminate at the edges of the mutually orthogonal pairs of faces 303, 305 and 304, 305, respectively.

FIGS. 6B-1 through 6B-4 show a first flue block 320 associated with the third tier 300 of blocks forming the corbel structure 12. As shown, the first flue block 320 defines a generally diagonally directed flue section 72*b*, 74*b* depending on which side of the third tier 300 that a particular one of the blocks 320 is positioned (see FIG. 2C). The opening of such flue sections 72*b*, 74*b* is substantially a rectangular shaped opening when viewed in plan which is symmetrically positioned with respect to the longitudinal and latitudinal axes of the block 320.

The flue block 320 has opposed top and bottom planar faces 323 and 324 respectively, and a substantially planar front face 325 formed on the boss 321 protruding outwardly from the block 320. A generally L-shaped step 330 is formed on the rear side of the block 320 opposite to the boss 321. The front face 325 is substantially mutually orthogonal to the top and bottom faces 323, 324 thereby defining respective parallel pairs of upper and lower edges therewith. Opposed vertically parallel side faces 327, 329 are mutually orthogonal to the top and bottom faces 323, 324. In addition, the opposed side faces 321*a*, 321*b* of the boss 321 are mutually orthogonal to the top and bottom faces 323 and 324, respectively.

The top face 323 at boss 321 includes a substantially horizontal elongate recessed groove 332. The side faces 321*a* and 321*b* of the boss 321 include substantially vertical elongate tongue 333 and grove 334, respectively. The bottom face 324 includes a substantially horizontal elongate protruding tongue 335 which is parallel to the groove 332 formed in the top surface 323. It will be observed that the groove 332 and tongue 335 include respective opposed ends that co-terminate with respective opposed ends of the groove 334 and tongue 333 at the edges of the side faces 321*a*, 321*b* and the mutually orthogonal top and bottom faces 323, 324, respectively along respective edges thereof.

It will be seen in FIG. 6 that the parallel grooves 312, 313 of the end block 302 respectively longitudinally align with the groove 332 of the flue blocks 320. In addition, the groove 334 and tongue 332 formed on the side faces 321*a*, 321*b* of the boss 321 will be correspondingly mated with the tongue 314 and the groove 315 formed on the front face 305 of the end block 302 so as to provide locking interconnection therebetween.

FIGS. 6C-1 through 6C-4 show a second flue block 340 associated with the third tier 300 of blocks forming the corbel structure 12. As shown, the third flue block 340, like the end block 302 and second flue block 320, is a corresponding generally inverted T-shaped block which defines a substantially diagonally oriented flue section 72*b*, 74*b* depending on the location of the block 340 in the third tier 300. The flue section 72*b*, 74*b* of block 340 is a substantially square-shaped opening as viewed in plan and is symmetrically oriented with respect to the latitudinal and longitudinal centerlines of the block 340.

The flue block 340 has opposed top and bottom planar faces 343 and 344 respectively, and a substantially planar front face 345 formed on the boss 341 protruding outwardly from the block 340. A generally L-shaped step 350 is formed on the rear side of the block 340 opposite to the boss 341. The front face 345 is substantially mutually orthogonal to the top and bottom faces 343, 344 thereby defining respective parallel pairs of upper and lower edges therewith. Opposed vertically parallel side faces 347, 349 are mutually orthogonal to the top and bottom faces 343, 344. In addition, the opposed side faces 341*a*, 341*b* of the boss 341 are mutually orthogonal to the top and bottom faces 343 and 344, respectively.

The top face 343 at boss 341 includes a substantially horizontal elongate recessed groove 342. The side faces 341*a* and 341*b* of the boss 341 include substantially vertical elongate tongue 353 and grove 354, respectively. The bottom face 344 includes a substantially horizontal elongate protruding tongue 355 which is parallel to the groove 352 formed in the top surface 343. It will be observed that the groove 352 and tongue 355 include respective opposed ends that co-terminate with respective opposed ends of the groove 354 and tongue 353 at the edges of the side faces 341*a*, 341*b* and the mutually orthogonal top and bottom faces 343, 344, respectively along respective edges thereof.

It will be seen in FIG. 6 that the groove 352 of each flue block 340 will be longitudinally aligned with a groove 332 of an adjacent flue block 320 and/or with an adjacent similar block 340. In addition, the groove 334 and tongue 332 formed on the side faces 321*a*, 321*b* of the boss 321 will be correspondingly mated with the tongue 314 and the groove 315 formed on the front face 305 of the end block 302 so as to provide locking interconnection therebetween.

Accompanying FIGS. 6D1 through 6D-3 and FIGS. 6E-1 through FIGS. 6E-3 represent first and second types of spacer blocks 360, 380, respectively that may be employed in the third tier of blocks. In this regard, the spacer block 360 and 380 are substantially identical to one another in that each includes a substantially rectangular block section having opposed planar top and bottom surfaces 363, 383 and 364, 384, respectively. The spacer block 360 also includes substantially planar vertical front and rear faces 365, 366, respectively, which are mutually orthogonal to the top and bottom surfaces 363, 364, respectively.

A parallel set of spaced apart grooves 370, 371 are formed in the top face 363 of the block 360. A corresponding parallel set of spaced apart tongues 372, 373 are formed on the bottom face 364 of the block 360. The front and rear faces 365, 366 will each include a respective spaced apart set of tongues 374, 375 and grooves 376, 377, respectively. The grooves 370, 371 and tongues 372, 373 each have opposed ends with co-terminate with respective ends of the tongues 374, 375 and grooves 376, 377 at an edge of the mutually orthogonal faces 363, 364, 365 and 366, respectively.

Unlike the spacer block 360 shown in FIGS. 6D1-6D3, the spacer block 380 shown in FIGS. 6E1-6E3 includes a boss section 381 protruding outwardly therefrom which defines substantially vertical planar front faces 385*a*, 385*b* on each side of the boss 385. The boss 381 itself defines a substantially vertical planar front face 385 which is parallel to but spaced away from the faces 385*a*, 385*b*. Each of the faces 385, 385*a* and 385*b* is parallel to the opposed substantially vertical planar rear face 386.

A parallel set of spaced apart grooves 390, 391 are formed in the top face 383 of the block 380. A corresponding parallel set of spaced apart tongues 392, 393 are formed on the bottom face 384 of the block 380. The front faces 385*a*, 385*b* and the rear face 386 will each include a respective spaced apart set of tongues 394, 395 and grooves 396, 397, respectively. The grooves 390, 391 and tongues 392, 393 each have opposed ends with co-terminate with respective ends of the tongues 394, 395 and grooves 396, 397 at an edge of the mutually orthogonal faces 383, 384, 385*a*, 385*b* and 386, respectively It will be observed in FIG. 6 that the first type of spacer block 260 may be positioned between an adjacent set of blocks 320 so that the grooves 370, 371 of the former are aligned with the grooves 332 of the latter. Furthermore, the second type of spacer block 280 may be positioned between adjacent blocks 320 and/or 340 so that each of the grooves 390, 391 thereof is aligned with respective grooves 332 and/or 352, respectively. Moreover, the tongues the tongues 374, 375 and grooves 376, 377 of the first type of spacer blocks 360 and the tongues 394, 395 and grooves 396, 397 of the second type of spacer blocks will be interconnected with respective ones of the grooves 334, 354 and tongues 333, 353 of the blocks 320 and/or 340, respectively, so as to interlock such blocks one to another. The aligned tongues 316, 317, 335, 355, 372, 392 of the tier three 300 blocks will also be interconnected to the aligned grooves 212, 213, 232, 242, 243 and 262 associated with the second tier 200 of blocks thereby interconnecting the second and third tiers 200 and 300, respectively, of blocks to one another.

The L-shaped steps 301*a*, 301*b*, 3330 and 350 of blocks 302, 320 and 340, respectively, receive a corresponding end portion of rectangular refractory bricks (a representative few of which are shown by reference numeral 399 in FIG. 6).

FIG. 7 is a perspective assembled view of the interconnected refractory blocks forming the fourth tier 400 of the corbel structure 12, with FIGS. 7A-1 through 7E-3 showing respective views of the individual refractory blocks thereof. In this regard, FIGS. 7A-1 through 7A-3 depict the end block 402 of the fourth tier 400. As shown, the end block 402 is a generally T-shaped block having opposed top and bottom faces 403, 404 respectively. A boss section 402-1 protrudes outwardly from the block 402 and includes a primary front face 405 which projects beyond but is parallel to the secondary front faces 405*a* and 405*b* on each side of the boss 402-1. Each of the faces 405, 405*a* and 405*b* is substantially vertically planar and parallel with respect to one another and with respect to the vertically planar primary rear face 406 formed on a rear boss 406-1 and secondary rear surfaces 406*a*, 406*b* formed on each side of the boss 406-1. In addition, each of the faces 405, 405*a* and 405*b* on the one hand and rear faces 406, 406*a* and 406*b* on the other hand is substantially mutually orthogonal to the top and bottom faces 403, 404 thereby defining respective parallel pairs of edges. Each of the opposed ends of blocks 302 includes an inverted L-shaped step 401*a*, 401*b*.

The front faces 405*a* and 405*b* formed adjacent to the boss 402-1 include an elongate substantially vertical elongate protruding tongue 414 and a substantially vertical recessed groove 415. The bottom face 406 includes a parallel pair of substantially horizontal elongate protruding tongues 416, 417. It will be observed that the groove 415 and tongue 417 include respective adjacent ends that co-terminate at an edge of the mutually orthogonal faces 404 and 405*b*. The tongues 414, 416 on the other hand have respective ends that co-terminate at the edges of the mutually orthogonal pairs of faces 405*a* and 404.

FIGS. 7B-1 to 7B-4 depict a first type of flue block 420 employed in fourth tier 400 of blocks forming the corbel structure 12. It will be observed in FIG. 7 that the fourth tier 400 will include an opposed back-to-back pair of the flue blocks 420 which are interconnected to the end block 402. Specifically, the flue block 420 integrally includes a base section 421 and a U-shaped flue section 422 extending upwardly from one end the base section 421. The base and flue sections 421, 422 define a respective top face 421*a*, 422*a*. An opposite end of the base section 421 includes an L-shaped step 423. The base and flue sections 421, 422 collectively define a section 72*c*, 74*c* of the lateral flues 72, 74 depending on the positioning of the block 420 in the fourth tier 400.

The flue block 420 has a substantially horizontal bottom face 426 which is parallel to each of the top faces 421*a*, 422*a*. Pairs of substantially vertical end faces 427*a*, 427*b* and 428*a*, 428*b* are mutually orthogonal to the top faces 421*a*, 422*a* and the bottom face 426 as well as the rear face 429. The end faces 427*a*, and 428 include a substantially vertical groove 430 and a substantially vertical tongue 431, respectively, while the bottom face 426 includes a substantially horizontal tongue 432. The opposed ends of the tongue 431 formed on the bottom face 426 co-terminate with ends of the groove 430 and tongue 431 formed on the end faces 427*a* and 428*a*, respectively, at respective edges of the mutually orthogonal bottom face 426 and the side faces 427*a*, 428*a*.

It will be observed from FIG. 7 that a pair of the lateral flue blocks 420 may be positioned back-to-back relative to one another adjacent the end block 402 such that the groove and tongues 430 and 431 interconnect with a tongue 414 and groove 415 of the end block 402. Further, it will be observed from FIG. 7 that the back-to-back positioned lateral flue blocks 420 will define a space therebetween establishing a part of the vertical flue portion 60*d* of the central flue 60.

Second and third types of flue blocks 440, 460, respectively, are shown by FIGS. 7C-1 through 7D-3. In this regard, the first and second types of flue blocks 440, 460 are substantially identical to one another in that each includes a base section 441, 461 and a central platform section 442, 462 having laterally opposed U-shaped ends 442*a*, 462*a* upwardly extending from the base section 441, 461, respectively. L-shaped lateral step regions 443*a*, 443*b* and 463*a*, 463*b*, respectively, are thereby defined laterally adjacent to the U-shaped ends 442*a*, 462*a*. A substantially vertical flue portion 60*d* of the central flue 60 and generally diagonally oriented flue sections 72*c*, 74*c* of the lateral flues 72, 74 are defined by the base and platform sections 441, 461 and 442, 462, respectively. The top face 444, 464 of the platform section 442, 462 is substantially horizontally parallel with the bottom face 445, 465 of the base section 441, 461. The substantially vertical opposed front face 446, 466 and rear face 447, 467 are mutually orthogonal to the top and bottom faces 444, 464 and 445, 475, respectively.

The front face 446, 466 includes a parallel vertically oriented tongue 448, 468 and groove 449, 469 pair whereas the rear face 447, 467 includes a mirror image pair of parallel vertically oriented groove 450, 470 and tongue 451, 471. The bottom surface 445, 465 includes a horizontally parallel pair of tongues 452, 472 and 453, 473. Each end of the tongues 452, 472 and 453, 473 co-terminates with a respective end of one of the tongues 448, 451 and 468, 471 and the grooves 449, 450 and 469 and 470 at an edge established between the mutually orthogonal front and rear faces 446, 466 and 447, 467 and the bottom face 445, 465. The block 440 includes a boss 447*a* extending outwardly from the rear face 447.

An exemplary longitudinal spacer block 480 employed in the fourth tier 400 of blocks is shown in FIGS. 7E-1 through 7E-3. As is shown in FIG. 7, the spacer blocks 480 are positioned end-to-end laterally adjacent the blocks 402, 440 and 460. Each spacer block 480 includes a generally rectangular body having opposed parallel substantially horizontal top and bottom faces 481, 482, respectively. An L-shaped step 482 is formed on one side of the block 402. The top face 481 includes an elongate channel 485 formed therein.

The L-shaped steps 423, 443*a*, 443*b*, 463*a*, and 463*b* of the blocks 420, 440, and 460, respectively, are sized so as to accommodate a respective one of the spacer blocks 480 so that the substantially vertically oriented rear face 487 thereof is abutted against the surfaces 427*b*, 428*b* and the U-shaped ends 442*a*, 462*a* to thereby collectively form a part of the lateral flue sections 72*c*, 74*c*, respectively. The L-shaped steps 483 of the spacer blocks 480 are adapted to receive an end region of a refractory floor brick (a few of which are identified in FIG. 7 by reference numeral 499).

It will be understood that the description provided herein is presently considered to be the most practical and preferred embodiments of the invention. Thus, the invention is not to be limited to the disclosed embodiments, but on the contrary, is intended to cover various modifications and equivalent arrangements included within the spirit and scope thereof.

What is claimed is:

1. A corbel structure for a coke oven comprising:

an assembly of multiple stacked tiers of refractory blocks defining a plurality of substantially vertically oriented central flues and a plurality of diagonally oriented flues positioned laterally of the central flues, wherein at least one tier of refractory blocks in the assembly includes a plurality of tongue-and-groove interconnected refractory blocks, and wherein the plurality of interconnected refractory blocks of the at least one tier comprise mutually substantially orthogonal faces defining an edge and respectively including an elongate tongue protruding outwardly therefrom and an elongate groove recessed therein, and wherein the elongate tongue and groove include respective adjacent ends which co-terminate with one another at the edge defined by the mutually orthogonal faces of the refractory blocks, wherein the at least one tier includes a plurality of transverse spanner flue blocks, wherein each transverse spanner flue block defines a respective vertical flue section of a vertically oriented central flue and a diagonal flue section of a respective diagonally oriented flue located laterally of the respective vertical flue section, and wherein the transverse spanner flue blocks of the at least one tier are comprised of:

(i) a base section; and (ii) a central platform section upwardly extending from the base section so as to define (a) opposed L-shaped lateral step regions, the central platform section defining the respective vertically oriented flue, and (b) upper and lower portions of each respective diagonally oriented flue, wherein (iii) the central platform section includes opposed laterally directed U-shaped ends defining the upper portion of each respective diagonally oriented flue; and wherein the at least one tier further comprises lateral spacer blocks positioned laterally of the at least one tier, wherein at least some of the lateral spacer blocks are positioned on the L-shaped lateral step regions in abutment with the U-shaped ends of the central platform.

2. The corbel structure according to claim 1, wherein the multiple stacked tiers of refractory blocks include a respective end block having a front face, wherein the front face includes a substantially vertically oriented tongue and a substantially vertically oriented groove parallel with the tongue, the tongue and groove of the front face being interconnected with a groove and tongue, respectively, of a substantially vertical face of an adjacent block in the tier.

3. The corbel structure according to claim 1, wherein the top faces of the blocks in the at least one tier have a parallel set of longitudinally extending grooves to receive therein a corresponding set of longitudinally extending tongues formed in a bottom face of an adjacently stacked tier on the at least one tier.

4. The corbel structure according to claim 1, wherein at least one other tier includes an opposed mirror image pair of generally cruciform-shaped blocks.

5. The corbel structure according to claim 4, wherein the cruciform-shaped blocks comprise an elongate central section, an inwardly projecting leg section and an outwardly projecting leg section, each of the inwardly and outwardly projecting leg sections being substantially perpendicular to the elongate central section.

6. The corbel structure according to claim 5, wherein the inwardly projecting leg section includes a parallel substantially vertically oriented tongue and groove.

7. The corbel structure according to claim 6, wherein the lateral side of the cruciform-shaped blocks includes a pair of downwardly and outwardly sloped surfaces on each side of the outwardly projecting leg section.

8. The corbel structure according to claim 1, wherein at least one other tier includes a plurality of alternating generally I-shaped transverse blocks interconnected with a respective pair of spacer blocks.

9. The corbel structure according to claim 8, wherein the I-shaped transverse blocks include opposed end sections, a central section between the end sections, and a boss protruding outwardly from substantially a mid-region of the central section.

10. The corbel structure according to claim 9, wherein the transverse blocks include a substantially vertical side opposite to the boss, and wherein the substantially vertical side includes a reentrant section between the opposed end sections which defines a first recess having lateral substantially planar recessed rear faces and a second recess having a substantially planar recessed central face.

11. The corbel structure according to claim 8, wherein the spacer blocks include downwardly and outwardly sloped lateral side surface.

12. The corbel structure according to claim 8, further comprising a lateral flue block defining a diagonally oriented flue section of the lateral flues, wherein the lateral flue block includes a boss extending outwardly from one side of the block and a generally L-shaped step extending outwardly from a side of the block opposite to the boss.

13. The corbel structure according to claim 12, wherein the boss includes opposed side faces having a tongue and groove respectively formed therein.

14. The corbel structure according to claim 12, wherein the lateral flue block has a top face defining a substantially rectangular opening to the flue portion, the opening being symmetrically positioned with respect to longitudinal and latitudinal axes of the flue block.

15. The corbel structure according to claim 12, wherein the lateral flue block has a top face defining a substantially rectangular opening to the flue portion, the opening being asymmetrically off-set with respect to a longitudinal centerline of the flue block but symmetrically positioned with respect to a latitudinal centerline of the flue block.

16. The corbel structure according to claim 1, wherein the at least one tier further comprises a back-to-back pair of lateral flue blocks each of which integrally includes a base section defining a top face, and a U-shaped flue section extending upwardly from one end of the base section.

17. The corbel structure according to claim 16, wherein others of the lateral spacer blocks are positioned on the top face of the base section in abutment with the U-shaped flue section extending upwardly from the base section of the lateral flue blocks.

18. The corbel structure according to claim 17, wherein the back-to-back pair of lateral flue blocks define a space therebetween, and wherein the at least one tier further comprises a T-shaped end block comprising an outwardly projecting boss which is positioned in the space defined between the back-to-back pair of lateral flue blocks.

19. A corbel structure for a coke oven comprising:

an assembly of multiple stacked tiers of refractory blocks defining a plurality of substantially vertically oriented central flues and a plurality of diagonally oriented flues positioned laterally of the central flues, wherein the at least one tier includes an assembly of a plurality of transverse spanner flue blocks, a pair of back-to-back lateral flue blocks, and lateral spacer blocks, wherein the transverse spanner flue blocks define a respective vertical flue section of a vertically oriented central flue and a diagonal flue section of a respective diagonally oriented flue located laterally of the respective vertical flue section, and wherein the transverse spanner flue blocks of the at least one tier are comprised of:

(i) a base section; and (ii) a central platform section upwardly extending from the base section so as to define (a) opposed L-shaped lateral step regions, the central platform section defining the respective vertically oriented flue and (b) upper and lower portions of each respective diagonally oriented flue, wherein (iii) the central platform section includes opposed laterally directed U-shaped ends defining the upper portion of each respective diagonally oriented flue; and wherein (iv) at least some of the lateral spacer blocks are positioned on the L-shaped lateral step regions in abutment with the U-shaped ends of the central platform, and wherein the back-to-back pair of lateral flue blocks define a space therebetween and are comprised of a base section defining a top face, and a U-shaped flue section extending upwardly from one end of the base section.

20. The corbel structure according to claim 19, wherein others of the lateral spacer blocks are positioned on the top face of the base section in abutment with the U-shaped flue section extending upwardly from the base section of the lateral flue blocks.

21. The corbel structure according to claim 19, wherein the at least one tier further comprises a T-shaped end block comprising an outwardly projecting boss which is positioned in the space defined between the back-to-back pair of lateral flue blocks.

* * * * *